US008165505B2

(12) United States Patent
Kojima

(10) Patent No.: US 8,165,505 B2
(45) Date of Patent: Apr. 24, 2012

(54) DEVELOPER CARTRIDGE ADAPTED TO RESTRICT LEAKAGE OF DEVELOPER

(75) Inventor: Tetsuji Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 345 days.

(21) Appl. No.: 12/195,888

(22) Filed: Aug. 21, 2008

(65) Prior Publication Data

US 2009/0052949 A1 Feb. 26, 2009

(30) Foreign Application Priority Data

Aug. 22, 2007 (JP) ..... 2007-215824

(51) Int. Cl.
*G03G 15/08* (2006.01)

(52) U.S. Cl. ..... 399/258; 399/102; 399/103; 399/106; 399/262

(58) Field of Classification Search ..... 399/260
See application file for complete search history.

(56) References Cited

U.S. PATENT DOCUMENTS

| | | | | |
|---|---|---|---|---|
| 5,608,501 | A * | 3/1997 | Makino | 399/119 |
| 6,292,644 | B1 * | 9/2001 | Goto et al. | 399/262 |
| 2004/0161266 | A1 * | 8/2004 | Ban et al. | 399/258 |
| 2006/0104671 | A1 * | 5/2006 | Murakami et al. | 399/258 |
| 2006/0104673 | A1 * | 5/2006 | Sasae et al. | 399/262 |
| 2006/0280526 | A1 * | 12/2006 | Shimomura | 399/258 |

FOREIGN PATENT DOCUMENTS

| | | |
|---|---|---|
| JP | 2006-243446 | 9/2006 |
| JP | 2006350229 A | 12/2006 |

* cited by examiner

*Primary Examiner* — David Gray
*Assistant Examiner* — David Bolduc
(74) *Attorney, Agent, or Firm* — Panitch Schwarze Belisario & Nadel LLP

(57) ABSTRACT

A developer cartridge includes a developer storing portion that stores a developer and has a first opening for taking out the developer, and a shutter member slidably mounted to the developer storing portion so as to open and close the first opening. The shutter member has a resilient-member-fixing portion to which a resilient member is fixed for preventing leakage of the developer through between the shutter member and the developer storing portion. A deflectable part is provided on at least one of the resilient-member-fixing portion and a peripheral portion of the first opening of the developer storing portion.

16 Claims, 19 Drawing Sheets

DEVELOPER CARTRIDGE ADAPTED TO RESTRICT LEAKAGE OF DEVELOPER

BACKGROUND OF THE INVENTION

This invention relates to a developer cartridge detachably mounted to an image forming portion. This invention also relates to an image forming unit and an image forming apparatus using the developer cartridge.

A conventional developer cartridge of a type which is detachably mounted to an image forming apparatus has a developer storing portion that stores developer. A developer outlet opening having an elongated shape is formed on the bottom of the developer storing portion. The developer cartridge further includes a shutter supported at both ends in the longitudinal direction thereof so as to slide to open and close the developer outlet opening. A seal member composed of resilient member is attached to the shutter. When the shutter closes the developer outlet opening, the seal member covers the developer outlet opening and is pressed against the peripheral portion of the developer outlet opening. Such a developer cartridge is disclosed by, for example, Japanese Laid-open Patent Publication No. 2006-243446 (paragraphs 0024-0040, FIGS. 1-5).

In the above described developer cartridge, there is a possibility that the developer may leak outside the developer storing portion even when the shutter closes the developer outlet opening.

SUMMARY OF THE INVENTION

An object of the present invention is to provide a developer cartridge, an image forming unit and an image forming apparatus capable of restricting the leakage of developer.

The present invention provides a developer cartridge including a developer storing portion that stores a developer and has a first opening for taking out the developer, and a shutter member slidably mounted to the developer storing portion so as to open and close the first opening. The shutter member has a resilient-member-fixing portion to which a resilient member is fixed for preventing leakage of the developer through between the shutter member and the developer storing portion. A deflectable part is provided on at least one of the resilient-member-fixing portion and a peripheral portion of the first opening of the developer storing portion.

The present invention also provides a developer cartridge including a developer storing portion that stores a developer and has a first opening for taking out the developer, a resilient member, and a shutter member mounted to the developer storing portion so that the shutter is rotatable about a rotation axis to open and close the first opening. The shutter member has a resilient-member-fixing portion to which a resilient member is fixed and a second opening adjacent to the resilient-member-fixing portion. The shutter member presses the resilient member against an inner surface of the developer storing portion. The shutter opens the first opening at a first rotational position where the second opening is overlapped with the first opening and closes the first opening at a second rotational position where the resilient member covers the first opening. The distance from the rotation axis to a surface of the resilient member is smaller at both ends of the resilient member in the direction of the rotation axis than at a center of the resilient member in the direction of the rotation axis.

With such an arrangement, the leakage of the developer can be restricted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings.

Embodiment 1.

Figure 1:
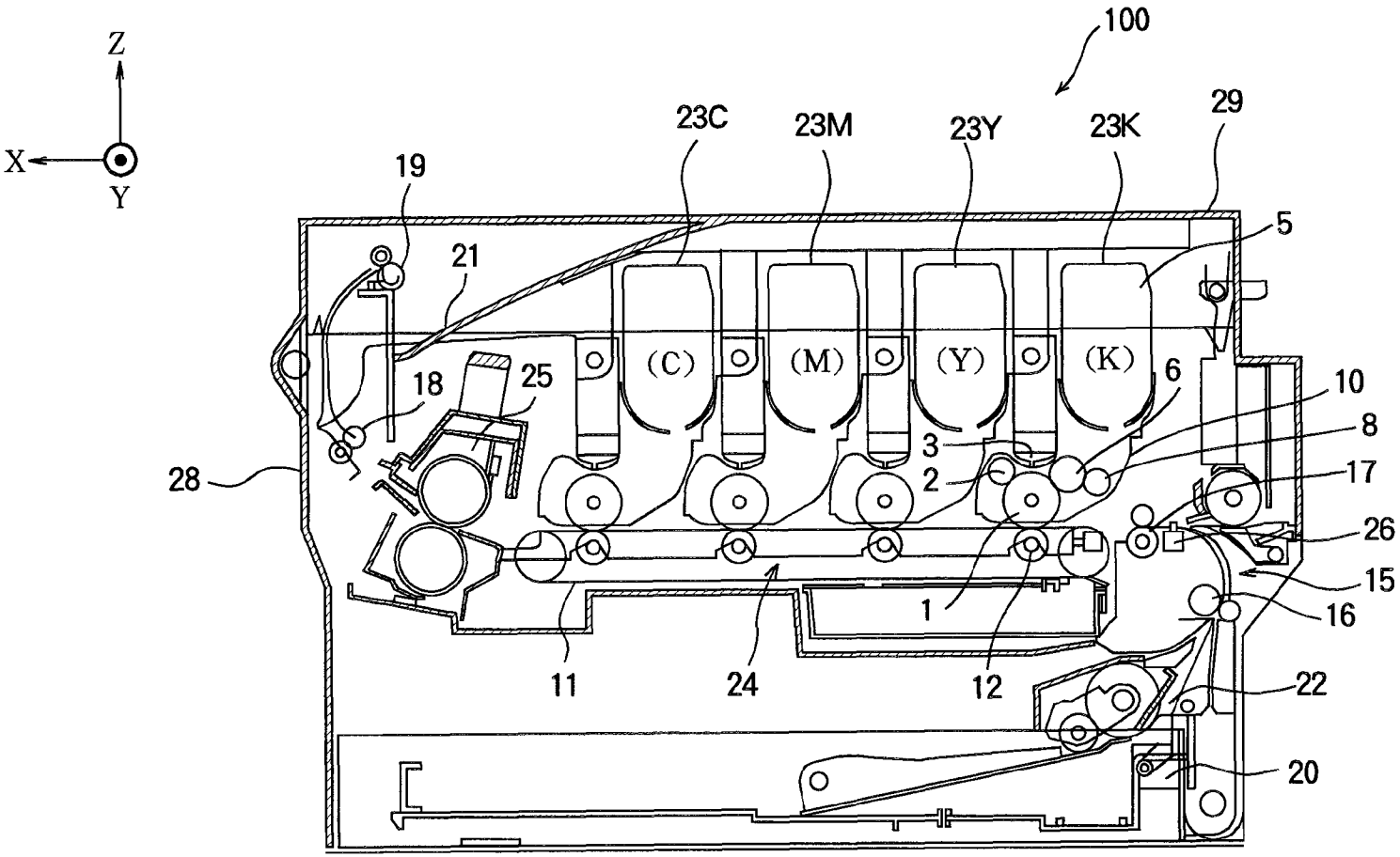
FIG. 1 is a schematic view showing a configuration of an image forming apparatus employing a toner cartridge according to Embodiment 1 of the present invention.

FIG. 1 is a schematic view showing an image forming apparatus using a toner cartridge according to Embodiment 1 of the present invention.

In FIG. 1, the image forming apparatus 100 has a configuration of a color electrophotographic printer capable of printing four colors, i.e., black (K), yellow (Y), magenta (M) and cyan (C).

The image forming apparatus 100 includes a lower frame 28 and an upper cover 29 constituting a casing of the image forming apparatus 100. A substantially S-shaped sheet feeding path 15 is defined in the lower frame 28. A sheet cassette 20 for storing recording sheets (i.e., recording medium) is disposed on the lower part of the lower frame 28, which corresponds to the upstream end of the sheet feeding path 15. A stacker 21 is disposed on the upper cover 29, which corresponds to the downstream end of the sheet feeding path 15.

A sheet pickup portion 22, a first feeding roller pair 16, a detecting portion 26, a second feeding roller pair 17, a feeding belt unit 24, a fixing unit 25, a third feeding roller pair 18 and a fourth feeding roller pair 19 are disposed along the sheet feeding path 15. The sheet pickup portion 22 picks up the recording sheet from the sheet cassette 20. The first feeding roller pair 16 feeds the recording sheet (picked up by the pickup portion 22). The detecting portion 26 detects the thickness of the recording sheet fed by the first feeding roller pair 16. The second feeding roller pair 17 feeds the recording sheet (fed by the first feeding roller pair 16). The feeding belt unit 24 has a transfer belt 11 that absorbs the recording sheet (fed by the second feeding roller pair 17) by means of electrostatic force and feeds the recording sheet using the transfer belt 11. The fixing unit 25 fixes the image (formed by image forming units described below) to the recording sheet.

Image forming units 23K, 23M, 23Y and 23C are disposed in opposition to the feeding belt unit 24 so that the recording sheet (adhering to and fed by the transfer belt 11) is sandwiched between the transfer belt 11 and the image forming units 23K, 23M, 23Y and 23C. The image forming units 23K, 23M, 23Y and 23C are disposed in a row in this order form the upstream to the downstream in the feeding direction of the recording sheet. The image forming units 23K, 23M, 23Y and 23C (collectively referred to as "the image forming unit 23") are detachably mounted to a main body of the image forming apparatus 100. In this embodiment, the image forming units 23K, 23M, 23Y and 23C have the same configuration except colors of the toners stored therein, and therefore the image forming unit 23K of black (K) will be herein explained as an example of the image forming units 23K, 23M, 23Y and 23C.

In FIG. 1, the X-axis is taken in the feeding direction of the recording sheet 13 (FIG. 2) when the recording sheet 13 passes the image forming units 23K, 23M, 23Y and 23C. The Y-axis is taken in the direction parallel to rotation axes of photosensitive bodies 1 (described later) of the image forming units 23K, 23M, 23Y and 23C. The Z-axis is taken in the direction perpendicular to both of the X-axis and Y-axis. In other figures, the X-axis, Y-axis and Z-axis indicate the same directions as defined in FIG. 1. That is, the XYZ-coordinates shown in respective figures indicate the orientations of parts shown in the respective figures when the parts are incorporated into the image forming apparatus 100 shown in FIG. 1.

Figure 2:
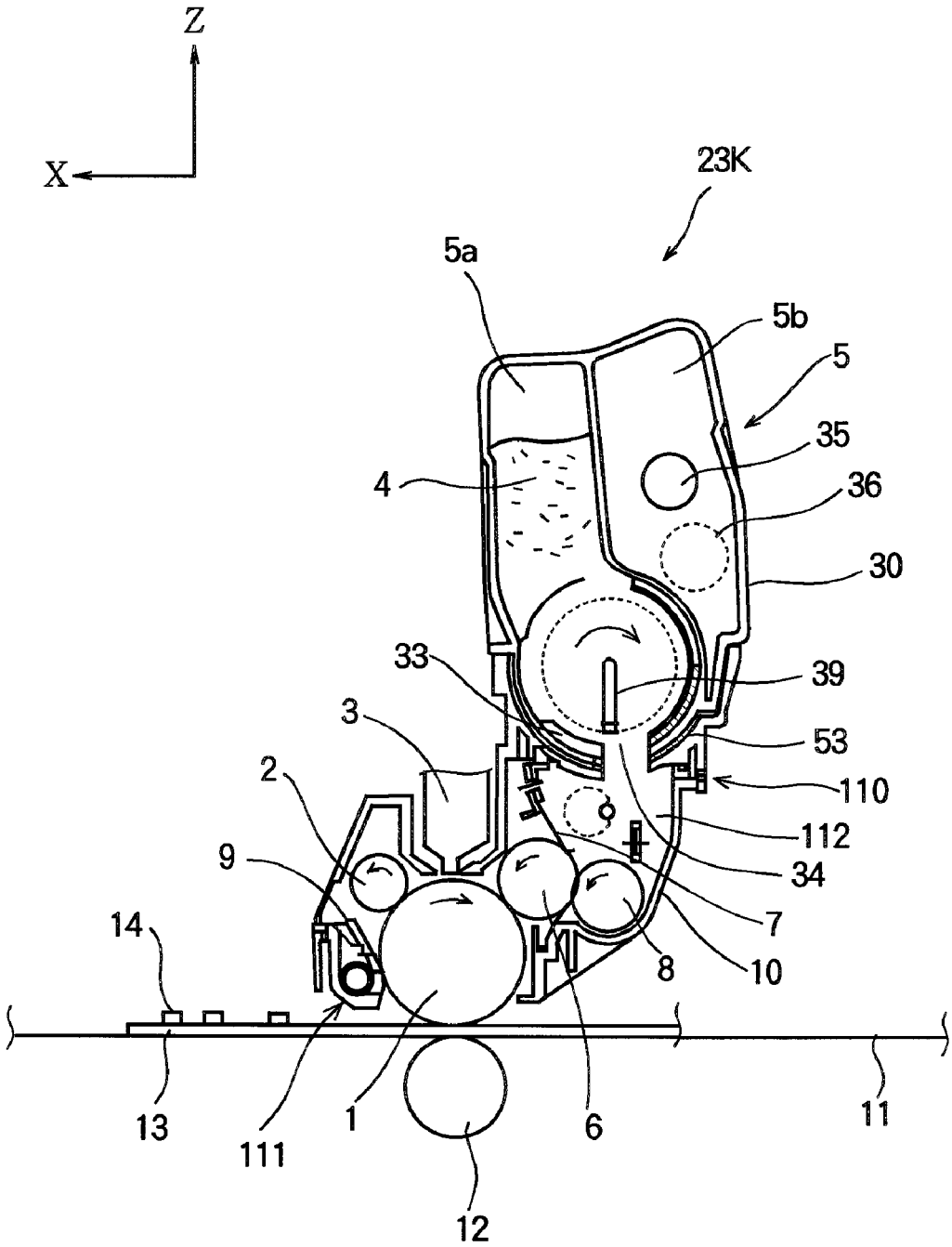
FIG. 2 is a sectional view showing a configuration of an image forming unit of black (K) of Embodiment 1 together with a transfer roller, an exposing unit and a recording sheet.

FIG. 2 is a sectional view schematically showing a configuration of the image forming unit 23K of black (K) together with the transfer roller 12, the exposing unit 3 and the recording sheet 13.

As shown in FIG. 2, the image forming unit 23*k* includes a photosensitive body 1 as an image bearing body that is rotatable in the direction indicated by an arrow. Along the circumference of the photosensitive body 1, a charging roller 2, an exposing unit 3, a developing unit 110 and a cleaning blade 9 are disposed in this order in the rotational direction of the photosensitive body 1.

The charging roller 2 contacts the surface of the photosensitive body 1 with a constant pressure, and electrically charges the surface of the photosensitive body 1. The exposing unit 3 exposes the uniformly charged surface of the photosensitive body 1 using a light source such as LED head or the like, so as to form a latent image. In this regard, the exposing unit 3 is provided on the upper cover 29 side (FIG. 1) of the main body of the image forming apparatus 100.

The developing unit 110 develops the latent image by causing the toner of predetermined color (black) to adhere to the surface of the photosensitive body 1 on which latent image is formed. The cleaning blade 9 removes the residual toner remaining on the surface of the photosensitive body 1 after the transferring to the recording sheet 13 so that the removed toner falls to a waste toner storing portion 111. The cleaning blade 9 is formed of a resilient body, and an edge portion of the cleaning blade 9 is pressed against the surface of the photosensitive body 1 with a constant pressure. Rotating bodies (i.e., respective rollers and the photosensitive body 1) are rotated by not shown driving sources via power transmission gears or the like.

The developing portion 110 includes a toner cartridge 5 (i.e., a developer cartridge) that stores a toner 4 (i.e., a developer). The toner cartridge 5 has a toner outlet opening 34 (i.e., a lower toner outlet opening) through which the toner 4 is supplied. The developing portion 110 further includes a toner reserving portion 112 for reserving the toner 4 supplied by the toner cartridge 5, a developing roller 6, a toner supplying roller 8 for supplying the toner 4 to the developing roller 6, and a developing blade 7 for forming a thin layer of the toner 4 on the developing roller 6. With such a configuration, the developing portion 110 develops the latent image formed on the photosensitive body 1 using the toner 4. In this regard, the image forming unit 23K is configured so that the toner cartridge 5 is detachably mounted above the toner supplying roller 8 as described later. A portion of the image forming unit 23 from which the toner cartridge 5 is detached (for example, as shown in FIG. 3B) is referred to as a main body 23*a* of the image forming unit 23. The outer part of the main body 23*a* of the image forming unit 23 is constituted by a casing 10.

The developing roller 6 and the toner supplying roller 8 are disposed in parallel to each other so that the developing roller 6 and the toner supplying roller 8 contact each other with a constant pressure, and rotate in the same direction as shown by arrows in FIG. 2. The developing blade 7 and the developing roller 6 are disposed in parallel to each other so that, for example, a bent portion of the developing blade 7 contacts the circumferential surface of the developing roller 6 with a constant pressure as shown in FIG. 2.

As shown in FIG. 1, four transfer rollers 12 are disposed in opposition to the respective photosensitive bodies 1 of four image forming units 23 in such a manner that the transfer rollers 12 are pressed against the photosensitive bodies 1 via the transfer belt 11 (that absorbs the recording sheet 13 with electrostatic force and feeds the recording sheet 13). The transfer rollers 12 transfer the toner images on the photosensitive bodies 1 to the recording sheet 13 (FIG. 2). For this purpose, each transfer roller 12 is applied with an electric potential so as to form an electric potential difference between surface potentials of each transfer roller 12 and the photosensitive body 1 facing the transfer roller 12. The transfer rollers 12 are composed of electrically conductive rubber or the like.

The fixing unit 25 (FIG. 1) includes a heat roller and a backup roller, and applies heat and pressure to the toner 14 (FIG. 2) having been transferred to the recording sheet 13 so that the toner 14 is fixed to the recording sheet 13. The recording sheet 13 (to which the toner 14 is fixed) is further fed by the fourth and fifth sheet feeding roller pairs 18 and 19 to the stacker 21 in which the recording sheets 13 are stacked.

Next, a mechanism for detachably mounting the toner cartridge 5 to the main body 23*a* of the image forming unit 23 will be described.

Figure 3A:
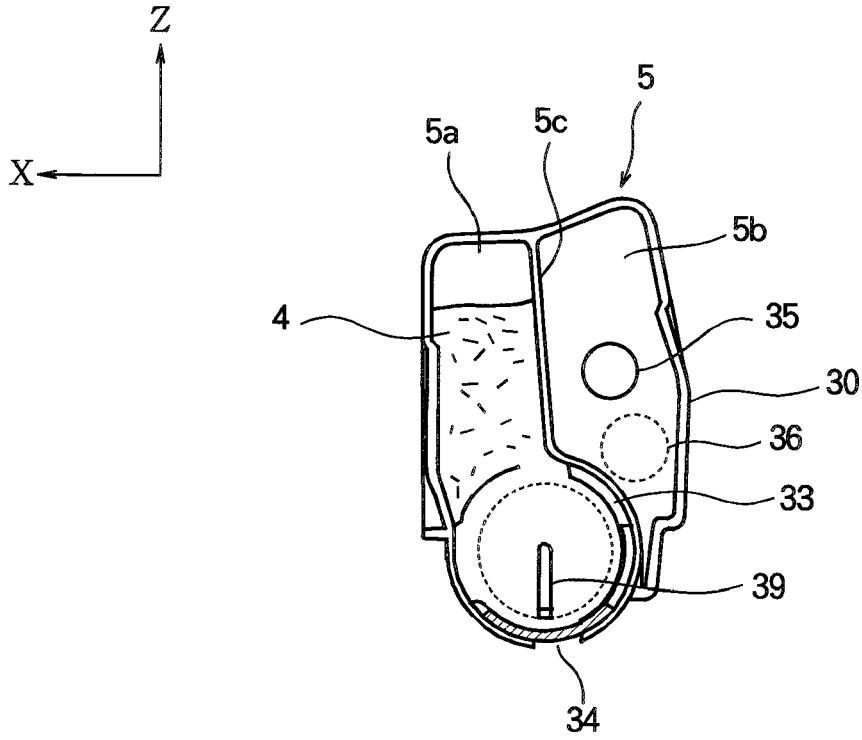
FIGS. 3A and 3B are sectional views showing the toner cartridge and a main body of the image forming unit of Embodiment 1 in a state where the toner cartridge is detached from the main body of the image forming unit.
Figure 3B:
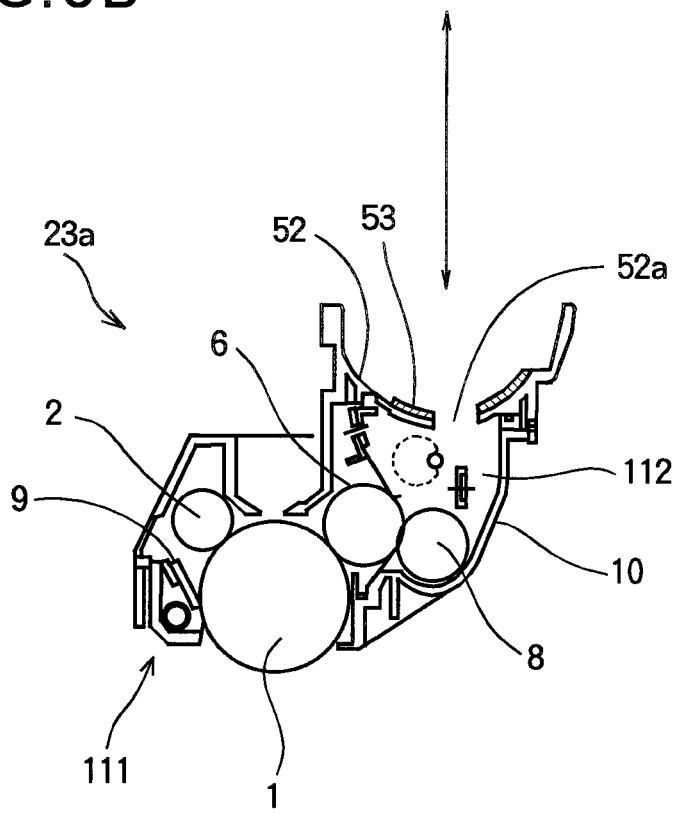
Figure 4:
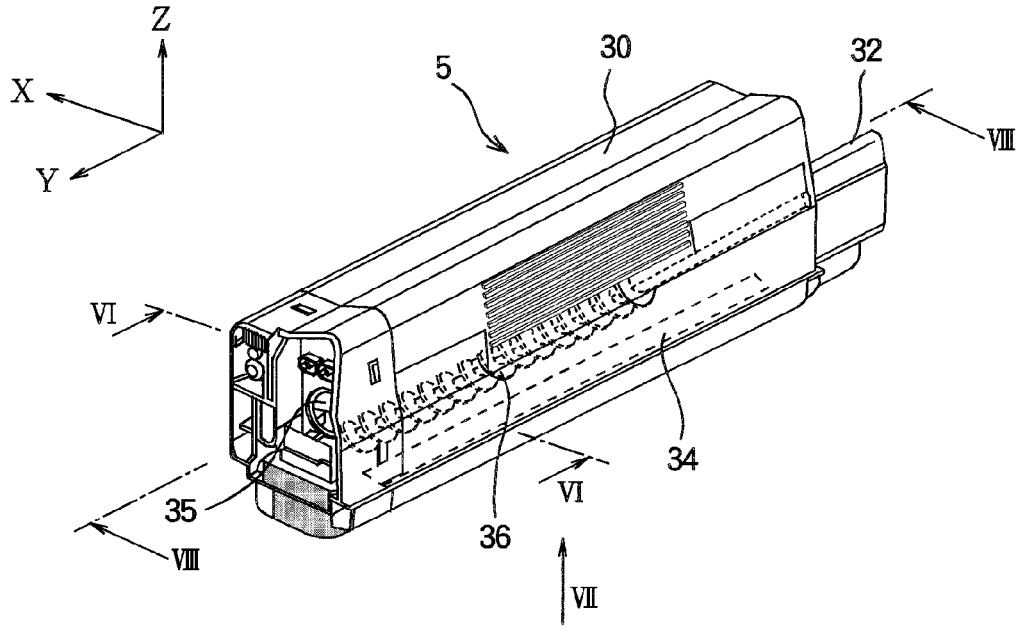
FIG. 4 is a perspective view showing an outer shape of the toner cartridge of Embodiment 1.
Figure 5:
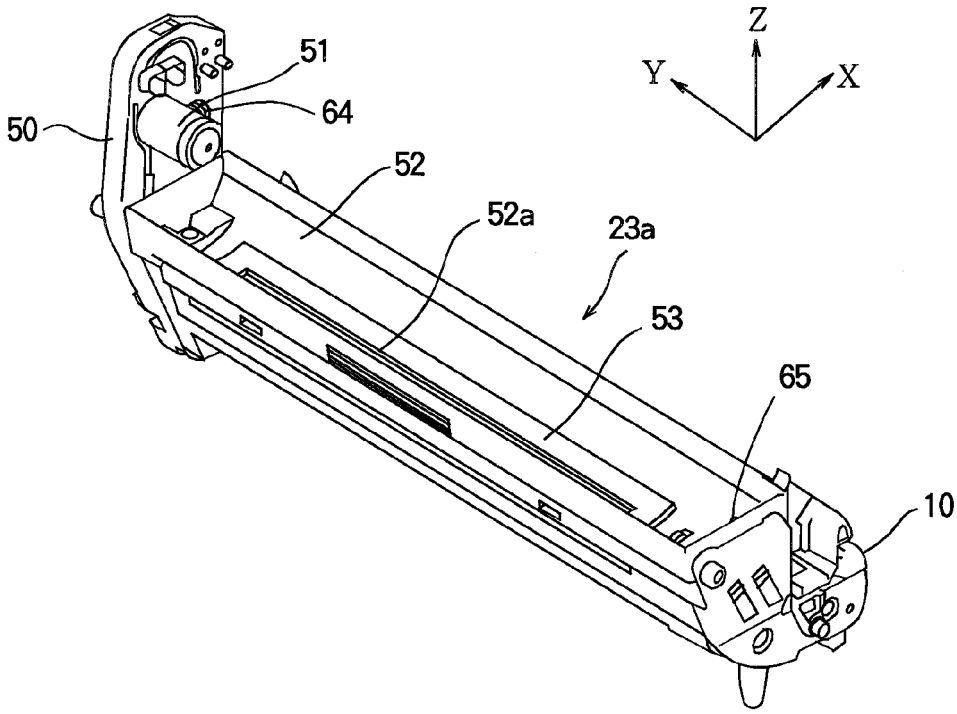
FIG. 5 is a perspective view showing an outer shape of the main body of the image forming unit of Embodiment 1.
Figure 6:
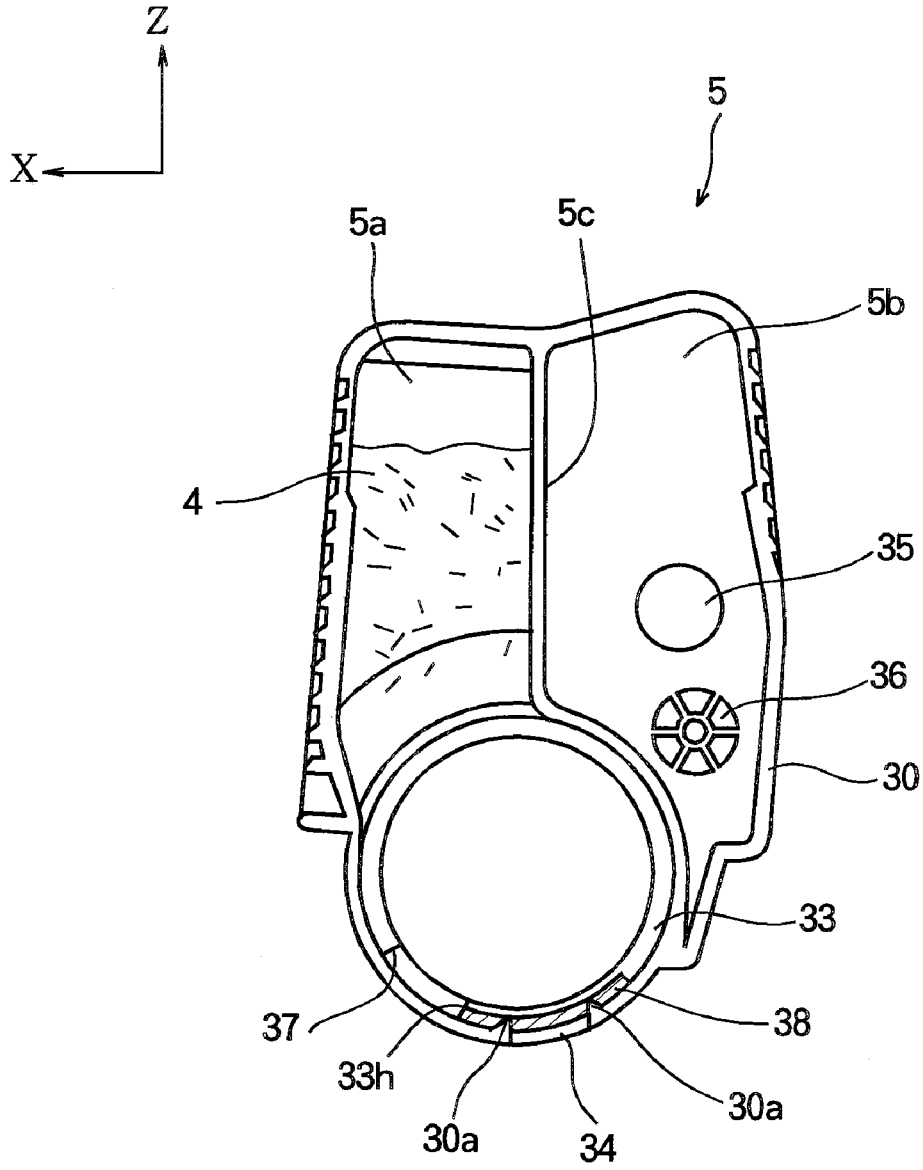
FIG. 6 is a sectional view showing the toner cartridge of Embodiment 1, taken along line VI-VI shown in FIG. 4.
Figure 7:
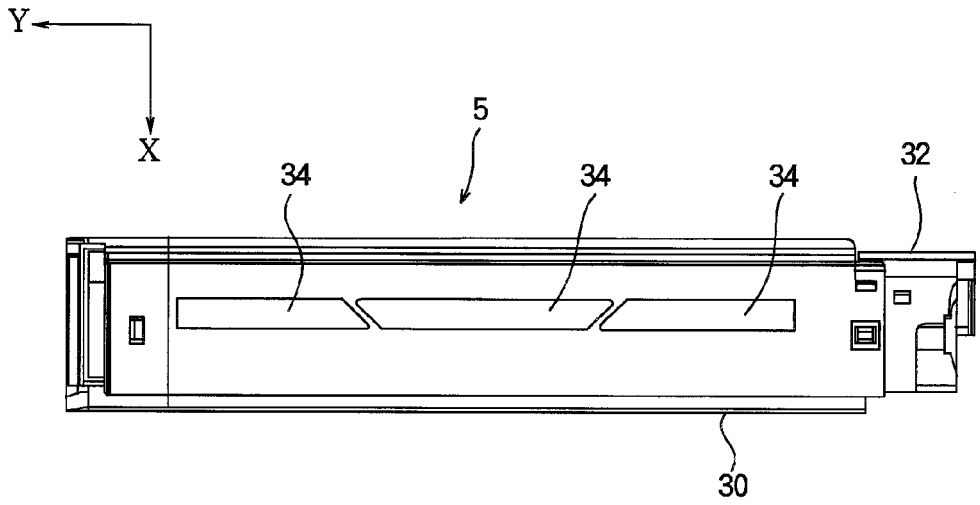
FIG. 7 shows an outer shape of the toner cartridge of Embodiment 1 as seen in the direction indicated by an arrow VII (as seen from below) shown in FIG. 4.
Figure 8:
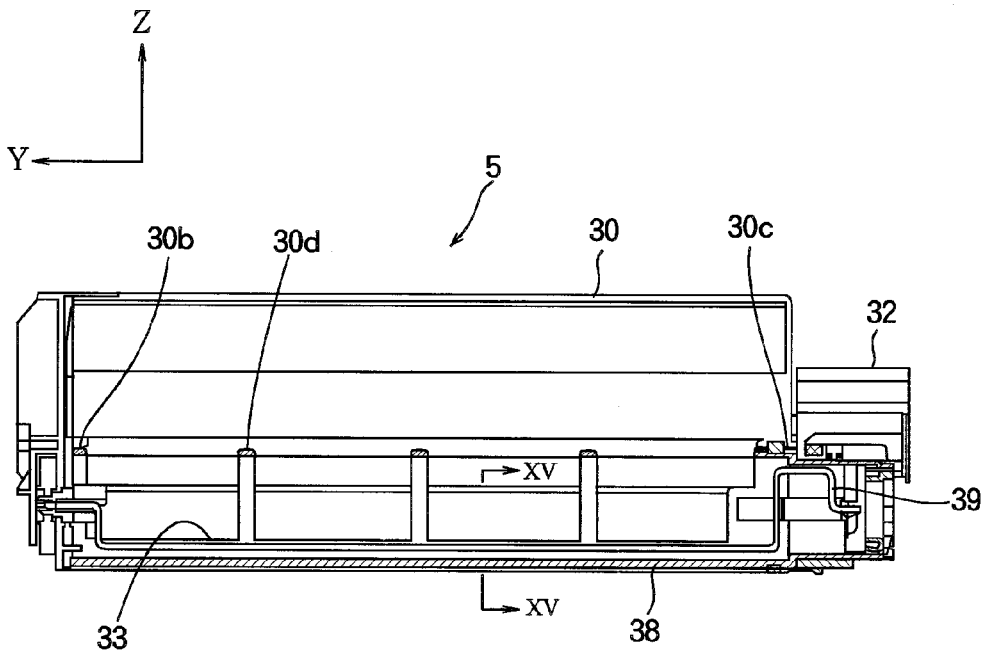
FIG. 8 shows an outer shape of the toner cartridge of Embodiment 1 as seen in the direction indicated by an arrow VIII (as seen in the X-direction) shown in FIG. 4.

FIGS. 3A and 3B are sectional views showing the toner cartridge 5 and the main body 23*a* of the image forming unit 23 in a state where the toner cartridge 5 is detached from the main body 23*a* of the image forming unit 23. FIG. 4 is a perspective view showing the outer shape of the toner cartridge 5. FIG. 5 is a perspective view showing the outer shape of the main body 23*a* of the image forming unit 23. FIG. 6 is a sectional view showing the toner cartridge 5, taken along line VI-VI shown in FIG. 4. FIG. 7 shows the outer shape of the toner cartridge 5 as seen in the direction indicated by an arrow VII shown in FIG. 4 (as seen from below). FIG. 8 is a sectional view showing the toner cartridge 5 taken along line VIII-VIII in FIG. 4 (as seen in the X-direction).

As shown in FIG. 3A, the toner cartridge 5 has a toner storing portion 5*a* (i.e., a developer storing portion) for storing the toner 4, and a waste toner storing portion 5*b* for storing the waste toner. The toner storing portion 5*a* and the waste toner storing portion 5*b* are parted by a partition wall 5*c*. A toner outlet opening 34 is formed on the bottom of the toner cartridge 5 through which the toner 4 (stored in the toner storing portion 5*a*) is taken out, i.e., supplied to the main body 23*a* of the image forming unit 23. The toner cartridge 5 has a shutter (i.e., a shutter member) 33 in the toner storing portion 5*a*, and the shutter 33 is rotatable to open and close the toner outlet opening 34. In a state where the toner cartridge 5 is detached from the main body 23*a* of the image forming unit 23, the toner outlet opening 34 is closed by the shutter 33. In the vicinity of the toner outlet opening 34, a toner agitating bar 39 is provided in the toner storing portion 5*a*. The toner agitating bar 39 is elongated in the longitudinal direction of the toner cartridge 5 as shown in FIG. 8, and both ends of the toner agitating bar 39 are rotatably supported by the toner cartridge 5. The toner agitating bar 39 is driven to rotate by a not shown driving mechanism.

An opening 35 is formed on the side wall of the toner cartridge 5, which accesses the interior of the waste toner storing portion 5*b*. The opening 35 is provided with a not shown shutter.

As shown in FIG. 4, a lever 32 is formed on the end of the shutter 33 as described later. The lever 32 is operated when the toner cartridge 5 is to be mounted to the main body 23*a* of the image forming unit 23. Further, a screw 36 is provided in the waste toner storing portion 5*b* of the toner cartridge 5. The screw 36 is driven by a not shown driving mechanism.

As shown in FIG. 3B, a frame upper part 52 is formed on the main body 23*a* of the image forming unit 23 for mounting the toner cartridge 5. The frame upper part 52 has a cross section of a substantially cylindrical concave shape. The frame upper part 52 is formed as a part of the casing 10. The frame upper part 52 has an opening 52*a* so that the opening 52*a* faces the toner outlet opening 34 in a state where the toner cartridge 5 is mounted to the main body 23*a*. The opening 52*a* has the same shape as the toner outlet opening 34. A urethane foam sheet 53 is attached to the peripheral portion of the opening 52*a*.

As shown in FIG. 5, a side frame 50 is formed on the main body 23*a* of the image forming unit 23 and adjacent to the frame upper part 52. A cylindrical waste toner outlet portion 51 is provided on the side frame 50, which ejects the waste toner removed by the cleaning blade 9 (FIG. 2). The waste toner outlet portion 51 has a not shown outlet opening through which the waste toner is ejected. A projection 64 is formed on the side frame 50 adjacent to the waste toner outlet portion 51. Another projection 65 is formed on the frame upper part 52 on the side opposite to the side frame 50.

When the toner cartridge 5 is mounted to the main body 23*a* of the image forming unit 23, the cylindrical waste toner outlet portion 51 (FIG. 5) is fit into the opening 35 (FIG. 4) formed on the side of the toner cartridge 5 while opening the shutter (not shown) of the opening 35. The toner cartridge 5 is mounted to the frame upper part 52 of the main body 23*a* of the image forming unit 23 while bringing the projection 64 (FIG. 5) on the side frame 50 into engagement with a not shown engaging hole formed on the corresponding portion of the toner cartridge 5. Then, the lever 32 (FIG. 4) is operated to rotate, and the projection 65 of the frame upper part 52 engages a groove (not shown) formed on the lever 32, so that the toner cartridge 5 is fixed to the frame upper part 52 of the main body 23*a* of the image forming unit 23. The shutter 33 is rotated together with the lever 32, and the toner outlet opening 34 of the toner cartridge 5 is opened as described later. With this, the toner storing portion 5*a* of the toner cartridge 5 and the toner reserving portion 112 (FIG. 2) in the main body 23*a* of the image forming unit 23 are spatially connected to each other.

The toner 4 stored in the toner storing portion 5*a* of the toner cartridge 5 is introduced to the toner outlet opening 34 by the rotation of the toner agitating bar 39, and introduced into the toner reserving portion 112 (FIG. 2) of the main body 23*a* of the image forming unit 23. As shown in FIG. 2, in a state where the toner cartridge 5 is mounted to the main body 23*a* of the image forming unit 23, the urethane foam sheet 53 is compressed between the toner cartridge 5 and the frame upper part 52, and prevents the toner 4 (taken out of the toner outlet opening 34) from leaking out.

In contrast, the waste toner (in the main body 23*a* of the image forming unit 23) is introduced into the waste toner storing portion 5*b* of the toner cartridge 5 via the outlet opening (not shown) of the waste toner outlet portion 51 inserted into the waste toner storing portion 5*b*. The screw 36 (FIG. 4) is rotated by the not shown driving mechanism to convey the waste toner (having been introduced into the waste toner storing portion 5*b*) frontward.

Next, the configuration of the shutter 33 provided in the toner storing portion 5*a* of the toner cartridge 5 will be described.

Figure 9:
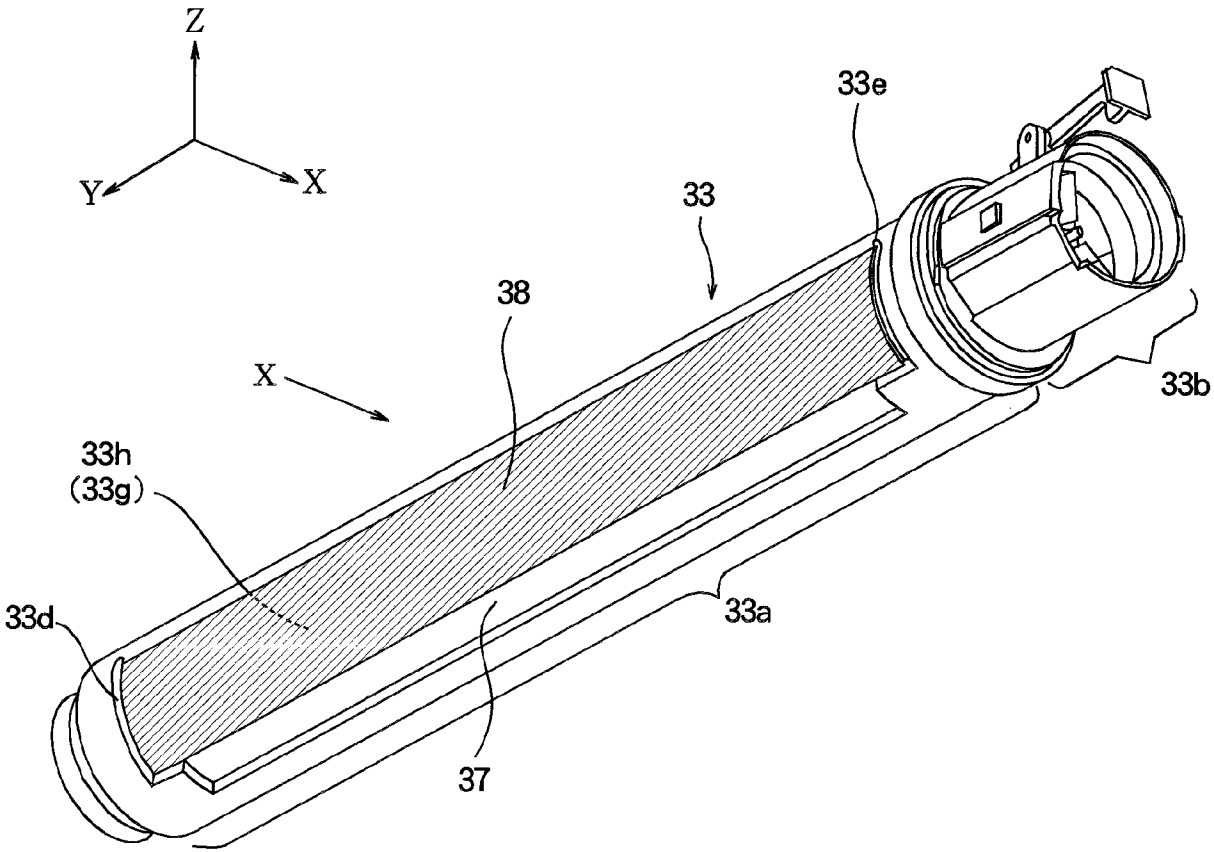
FIG. 9 is a perspective view showing the shutter of Embodiment 1 as obliquely seen from below.
Figure 10:
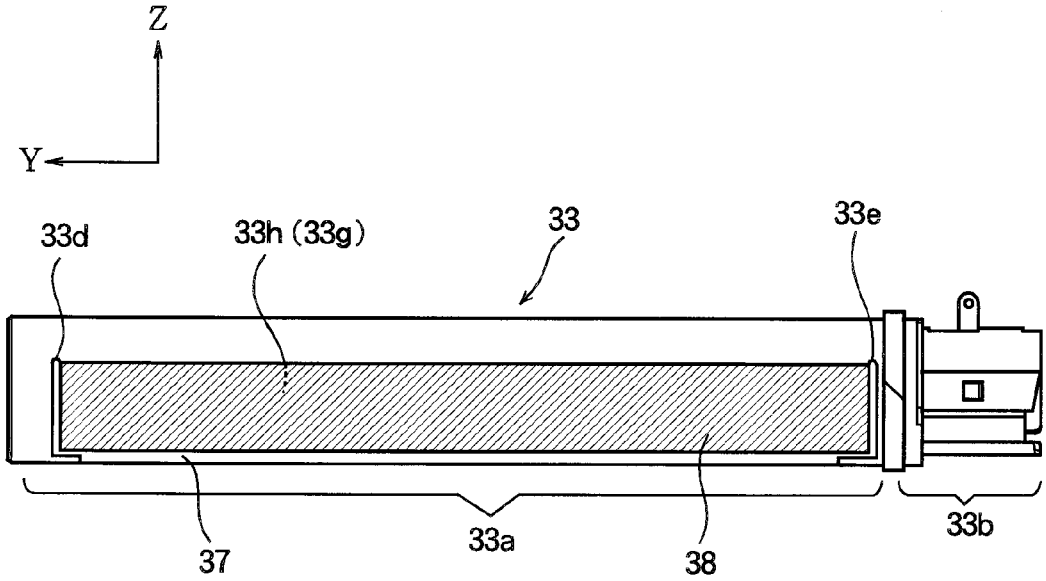
FIG. 10 shows the shutter of Embodiment 1 as seen in the direction indicated by an arrow X shown in FIG. 9.
Figure 11:
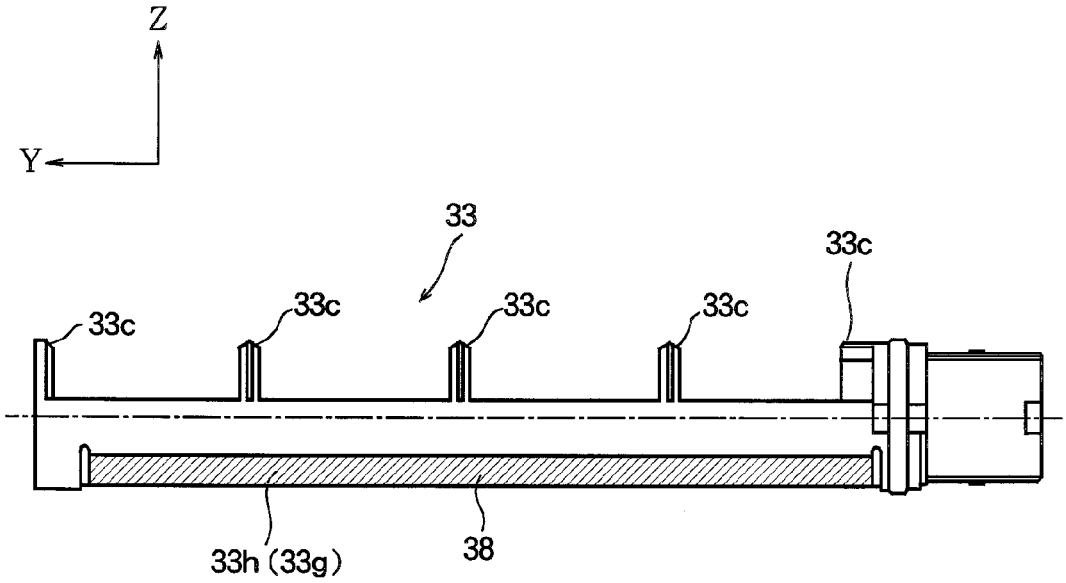
FIG. 11 shows the shutter of Embodiment 1 in a state where the shutter has rotated by approximately 90 degrees about Y-axis from the state shown in FIG. 10.
Figure 12:
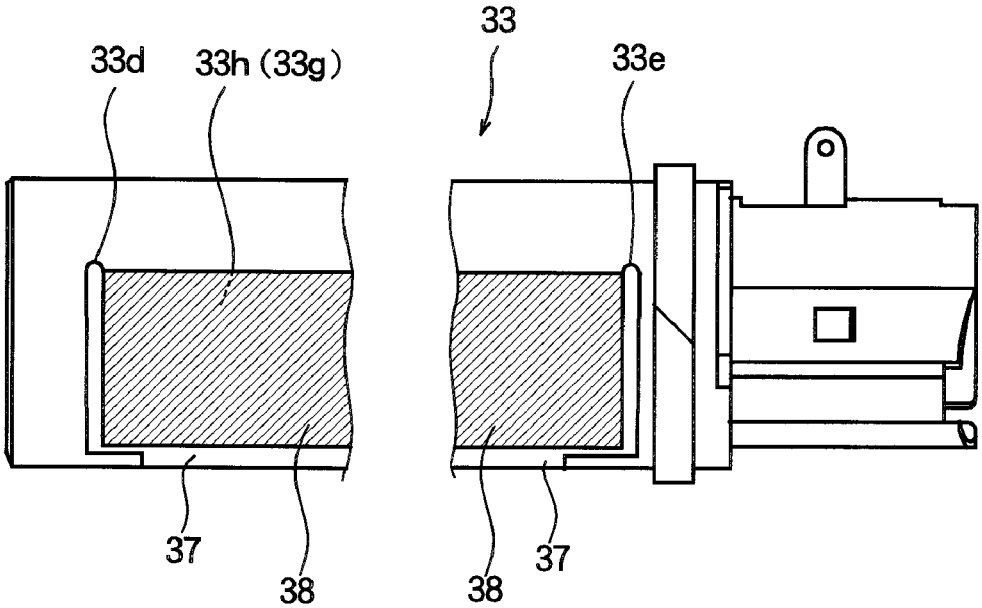
FIG. 12 is an enlarged view showing both ends of the shutter shown in FIG. 10.
Figure 13:
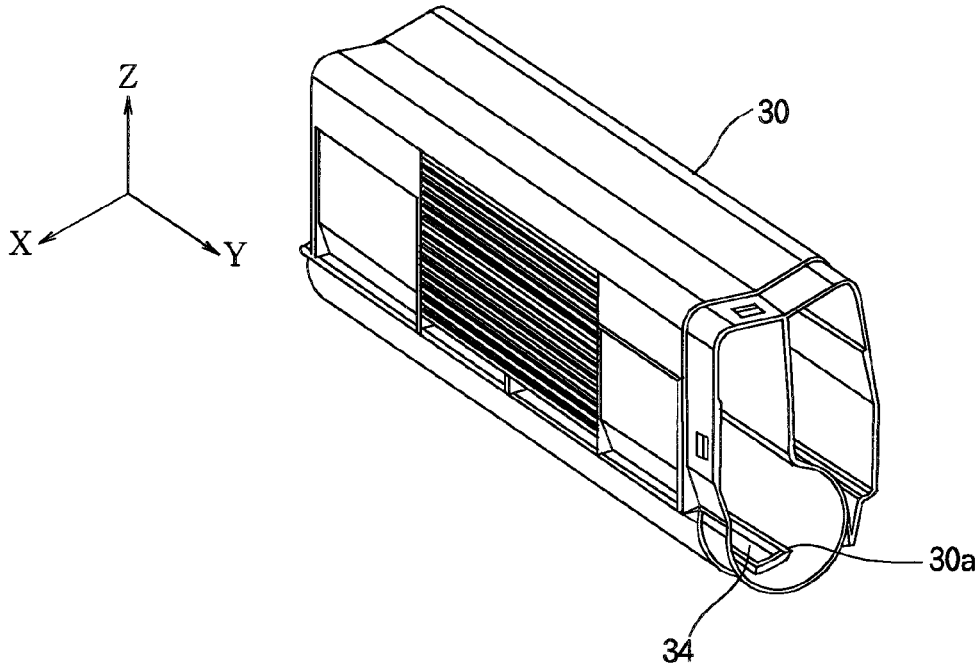
FIG. 13 is a perspective view showing a casing of the toner cartridge of Embodiment 1.
Figure 14:
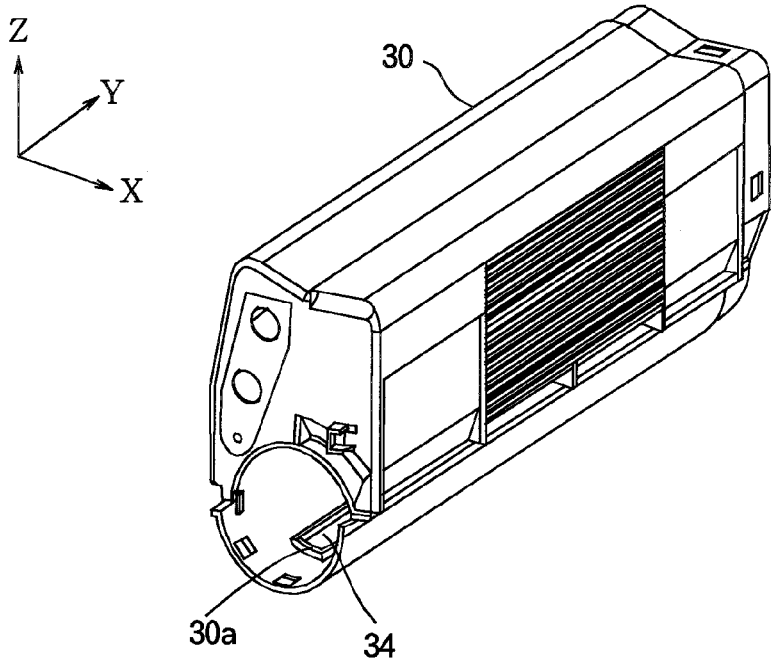
FIG. 14 is a perspective view showing the casing of the toner cartridge of Embodiment 1 as seen in the different direction from FIG. 13.

FIG. 9 is a perspective view showing the shutter 33 as obliquely seen from below. FIG. 10 shows the shutter 33 as seen in the direction indicated by an arrow X shown in FIG. 9. FIG. 11 shows the shutter 33 in a state where the shutter 33 has rotated by approximately 90 degrees about Y-axis from the state shown in FIG. 10. FIG. 12 is an enlarged view showing both ends of the shutter 33 shown in FIG. 10. FIG. 13 is a perspective view showing a casing 30 of the toner cartridge 5. FIG. 14 is a perspective view showing the casing 30 of the toner cartridge 5 as seen in the different direction from FIG. 13.

As shown in FIGS. 9 and 10, the shutter 33 has a shutter portion 33*a* and a driving portion 33*b*. The above described lever 32 (FIG. 7) is mounted to the driving portion 33*b*, and the driving portion 33*b* receives the rotational force applied to the lever 32. The shutter portion 33*a* has a substantially cylindrical portion half of which is removed except five ribs 33*c* formed at constant intervals. As shown in FIG. 9, the shutter portion 33*a* has an elongated opening 37. The opening 37 has the shape substantially the same as, or slightly larger than the toner outlet opening 34 (FIG. 7) of the toner cartridge 5. As shown in FIGS. 9, 15A, 15B and 15C, a seal-member-fixing portion 33*h* (i.e., a resilient-member-fixing portion) is formed on an area directly adjacent to the opening 37 in the circumferential direction of the shutter 33. The seal-member-fixing portion 33*h* is larger than the outer dimension of the opening 37. A resilient seal member 38 (i.e., a resilient member) is bonded to the seal-member-fixing portion 33*h*. The resilient seal member 38 is composed of, for example, a sponge. The seal-member-fixing portion 33*h* is thinner than the other portion of the shutter portion 33*a*, to thereby facilitate the positioning of the resilient seal member 38 and to partially reduce the rigidity so that the seal-member-fixing portion 33*h* easily deflects.

A longer side of the seal-member-fixing portion 33*h* (to which the resilient seal member 38 is bonded) faces the opening 37. Further, cutout portions 33*d* and 33*e* are formed on both sides of the seal-member-fixing portion 33*h* (in the longitudinal direction of the shutter 33) so as to extend from the opening 37. As shown in FIG. 10, the cutout portions 33*d* and 33*e* extend beyond the area of the seal-member-fixing portion 33*h* by a predetermined distance. A rectangular part surrounded by the cutout portions 33*d* and 33*e* and the opening 37 at three sides is referred to as a cantilever portion 33*g* (i.e., a deflectable part). The cantilever portion 33*g* has three free ends along the cutout portions 33*d* and 33*e* and the opening 37 and one remaining end connected to the other portion of the shutter portion 33*a*.

As shown in FIGS. 13 and 14, a protrusion 30*a* is formed around the toner outlet opening 34 of the casing 30 of the toner cartridge 5 so that the protrusion 30*a* surrounds the toner outlet portion 34.

The above configured shutter 33 is mounted to the casing 30 of the toner cartridge 5 as shown in FIG. 8. In this state, both ends portions (where the ribs 33*c* are formed) of the shutter 33 are rotatably supported by rotation supporting portions 30*b* and 30*c* formed on both ends of the casing 30 in the longitudinal direction of the casing 30. In this regard, the position of the shutter 33 and the internal shape of the toner cartridge 5 are determined so that the resilient seal member 38 fixed to the shutter 33 is pressed against and slidably contacts the inner surface of the casing 30 (i.e., the inner surface of the toner storing portion 5*a*) when the shutter 33 rotates in the toner storing portion 5*a* of the toner cartridge 5. The casing 30 is provided with a cover guide 30*d* that guides the other ribs 33*c* (than the ribs 33*c* supported by rotation supporting portions 30*b* and 30*c*).

Therefore, when the shutter 33 is in a rotational position in the toner cartridge 5 where the opening 37 is directed downward as shown in FIG. 10, the opening 37 and the toner outlet opening 34 of the toner cartridge 5 are overlapped with each other, i.e., the toner outlet opening 34 is opened. In contrast, when the shutter 33 is in a rotational position in the toner cartridge 5 where the seal-member-fixing portion 33*h* is directed downward as shown in FIG. 11, the toner outlet opening 34 is covered by the resilient seal member 38, i.e., the toner outlet opening 34 is closed. In a state where the toner outlet opening 34 is closed, the protrusion 30*a* surrounding the toner outlet opening 34 is pushed into the resilient seal member 38, and therefore the leakage of the toner from the toner cartridge 5 is prevented.

The operation for mounting the toner cartridge 5 to the frame upper part 52 of the main body 23*a* of the image forming unit 23 and for rotating the shutter 33 will be described with reference to FIGS. 15A through 15C.

Figure 15A:
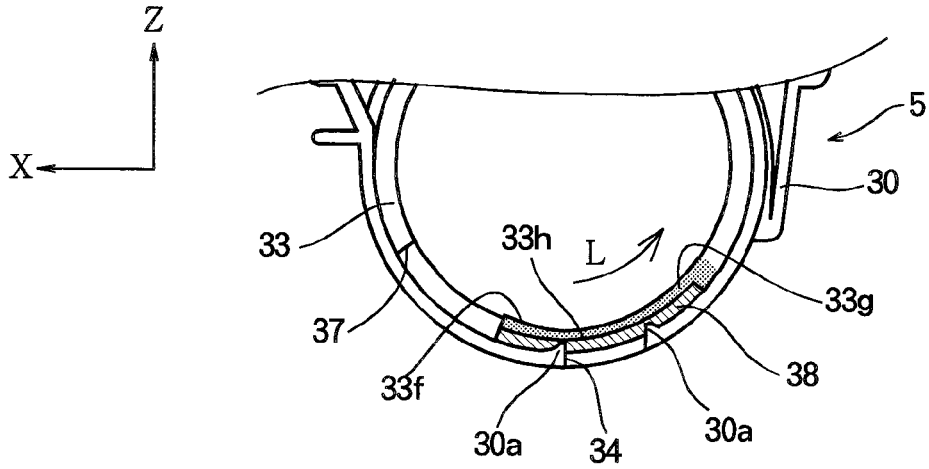
FIGS. 15A through 15C are schematic views for illustrating the operation of the shutter of Embodiment 1.
Figure 15B:
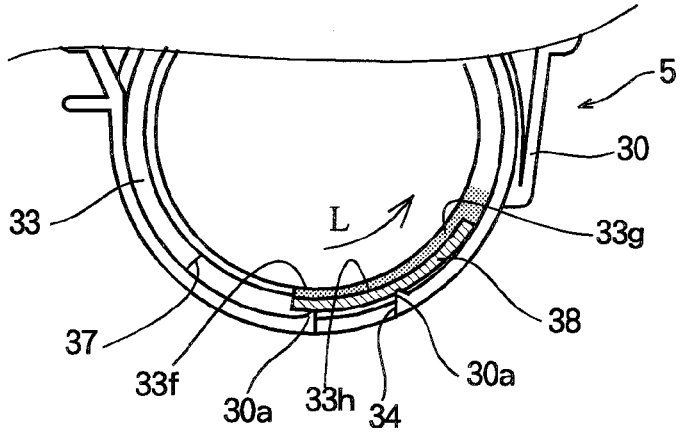
Figure 15C:
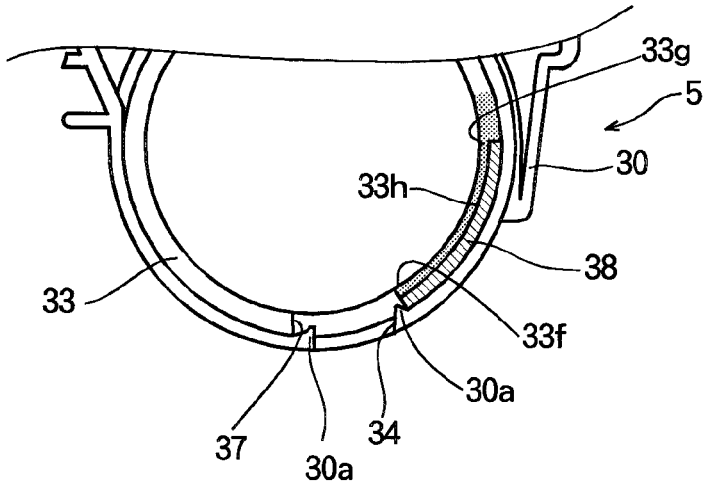

FIGS. 15A through 15C are partial sectional views of the toner cartridge 5 taken along line XV-XV in FIG. 8. FIG. 15A shows a state where the shutter 33 closes the toner outlet opening 34 of the toner cartridge 5. In the state shown in FIG. 15A, the protrusion 30*a* surrounding the toner outlet opening 34 is pushed into the resilient seal member 38 due to the pressing force of the resilient seal member 38. With this, the pressing force applied to the protrusion 30*a* increases, and a leakage path of the toner becomes nested (compared with the case where no protrusion 30*a* is provided). Therefore, the leakage of the toner is prevented by the protrusion 30*a*.

In FIGS. 15A through 15C, the cantilever portion 33*g* (having been described with reference to FIG. 9) is shown by shading. The cantilever portion 33*g* is formed by providing the cutout portions 33*d* and 33*e* (FIG. 9). The cantilever portion 33*g* has a tip 33*f* facing the opening 37. A portion of the cantilever portion 33*g* closer to the tip 33*f* is more likely to be deflected. With such a structure, the cantilever portion 33*g* is deflected by the pressure applied by the casing 30 via the protrusion 30*a* so that the tip 33*f* shifts inward. Therefore, even when, for example, there is a variation in dimension of the protrusion 30*a*, thickness of the resilient seal member 38 or the like, a variation (in particular, an increase) in load can be restricted by the deflection of the cantilever portion 33*g*.

Further, when pressing force is applied to peripheral portion of the toner outlet opening 34 of the casing 30, the increase in pressing force at both ends is restricted due to the deflection of the cantilever portion 33*g*. Therefore, the distribution of the pressing force (applied to the resilient seal member 38) in the longitudinal direction becomes uniform. This prevents the toner leakage at the center portion of the resilient seal member 38 (otherwise caused by the distribution of the pressing force which is weaker at the center portion than at both end portions).

FIG. 15B shows a state where the shutter 33 is rotated in the direction shown by an arrow L and the resilient seal member 38 is slid in the same direction along the toner outlet opening 34 of the toner cartridge 5. In this state, the resilient seal member 38 fixed to the cantilever portion 33*g* is pressed by the protrusion 30*a*, and therefore the cantilever portion 33*g* is slightly deflected inward while the shutter 33 moves in the direction L. Therefore, the pushing amount of the protrusion

30*a* into the resilient seal member 38 is reduced, which prevents the increase in load (torque) while rotating the shutter 33.

FIG. 15C shows a state where the opening 37 of the shutter 33 and the toner outlet opening 34 are overlapped with each other and where the rotation of the shutter 33 in the direction L is stopped by a not shown limiter. In this state, the tip 33*f* of the cantilever portion 33*g* passes the protrusion 30*a*, and the cantilever portion 33*g* returns to its original state where the deflecting amount is small. Thereafter, the agitating bar 39 (FIG. 2) of the toner cartridge 5 is rotated in accordance with the printing operation, and the toner stored in the toner storing portion 5*a* is introduced to the toner outlet opening 34, and is supplied to the toner reserving portion 112 (FIG. 2) of the main body 23 of the image forming unit 23. In this regard, when the shutter 33 is in the rotational position shown in FIG. 15C, the projection 65 (FIG. 5) of the frame upper part 52 engages the not shown groove of the lever 32 (FIG. 4), so that the toner cartridge 5 is fixed to the frame upper part 52 of the main body 23*a* of the image forming unit 23.

In contrast, when the toner cartridge 5 is to be detached from the main body 23*a* of the image forming unit 23, the lever 32 (FIG. 4) is rotated in the direction opposite to the direction L so as to release the fixing of the toner cartridge 5 and to close the toner outlet opening 34. The shutter 33 rotates from the position shown in FIG. 15C to the position shown in FIG. 15A, while the resilient seal member 38 is pressed against the protrusion 30*a* and slides in the direction opposite to the direction L. During this rotation, the cantilever portion 33*g* is deflected inward (so that the tip 33*f* shifts inward) due to the pressing force applied by the casing 30 via the protrusion 30*a*, and therefore the increase in load is restricted.

In this embodiment, the seal-member-fixing portion 33*h* (on which the resilient seal member 38 is bonded) is thinner than the other portion of the shutter portion 33*a* as shown in FIG. 9, and the deflectable cantilever portion 33*g* is defined by the cutout portions 33*d* and 33*e* and the opening 37 at three sides as shown in FIGS. 9, 15A, 15B and 15C. However, this embodiment is not limited to such a configuration. For example, it is also possible that the thickness of the seal-member-fixing portion 33*h* is the same as the other portion of the shutter portion 33*a*.

To be more specific, it is possible to form portions corresponding to the cutout portions 33*d* and 33*e* to be thinner than the other portion of the shutter portion 33*a*, or to form flexible portions (corresponding to the cutout portions 33*d* and 33*e*) using a resilient member such as a spring or the like so as to allow the deflection of the cantilever portion 33*g*. Furthermore, it is also possible to form the cantilever portion 33*g* using a resilient member such as a spring or the like.

Figure 16A:
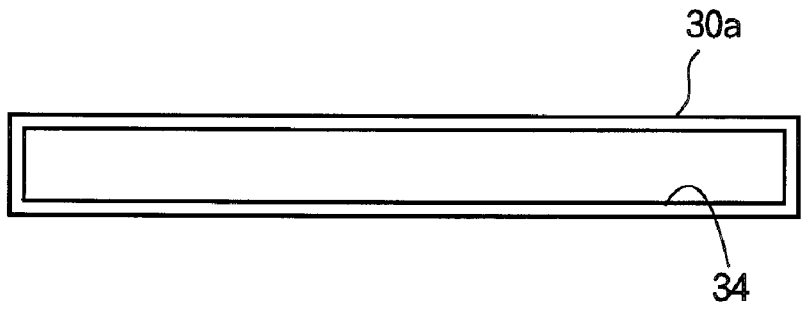
FIGS. 16A through 16C are schematic views for illustrating modifications of the protrusion formed around a toner outlet opening of the casing of the toner cartridge of Embodiment 1.
Figure 16B:
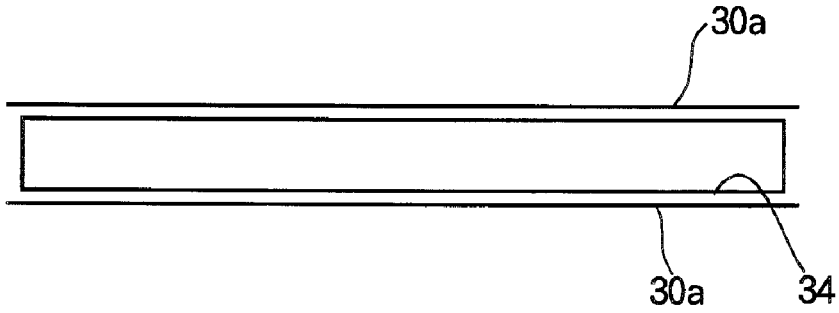
Figure 16C:
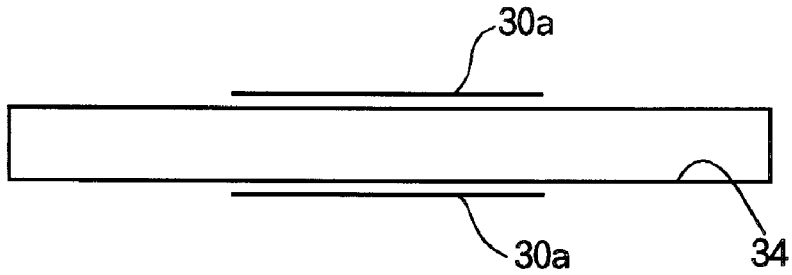

FIG. 16A shows the protrusion 30*a* formed around the toner outlet opening 34 of the toner cartridge 5 of this embodiment. FIGS. 16B and 16C show modifications of the protrusion 30*a*. Although the protrusion 30*a* is formed to surround the toner outlet opening 34 of the toner cartridge 5 in this embodiment as shown in FIG. 16A, the present invention is not limited to such a configuration. For example, as shown in FIG. 16B, it is also possible to form protrusions 30*a* on both sides of the toner outlet opening 34 so as to extend throughout the length of the toner outlet opening 34. Further, as shown in FIG. 16C, it is also possible to form protrusions 30*a* on both sides of the toner outlet opening 34 so as to extend along a part of the toner outlet opening 34.

As described above, according to the first embodiment of the present invention, the seal-member-fixing portion 33*h* (on which the resilient seal member 38 is bonded) is in the form of the deflectable cantilever portion 33*g* due to the provision of the cutout portions 33*d* and 33*e* or the like. Therefore, the increase in load while operating the shutter 33 can be restricted even when the protrusion 30*a* is formed around the toner outlet opening 34 of the toner cartridge 5 for preventing the leakage of the toner.

Further, the distribution of the pressing force applied to the resilient seal member 38 in the longitudinal direction thereof becomes uniform, and therefore the leakage of the toner can be prevented.

Moreover, the increase in load can be restricted, even when there is a variation in dimension of the protrusion 30*a*, thickness of the resilient seal member 38 or the like.

Additionally, the leakage of the toner can be further restricted by the rib-like protrusion 30*a* which is pushed into the resilient seal member 38.

Embodiment 2.

Figure 17:
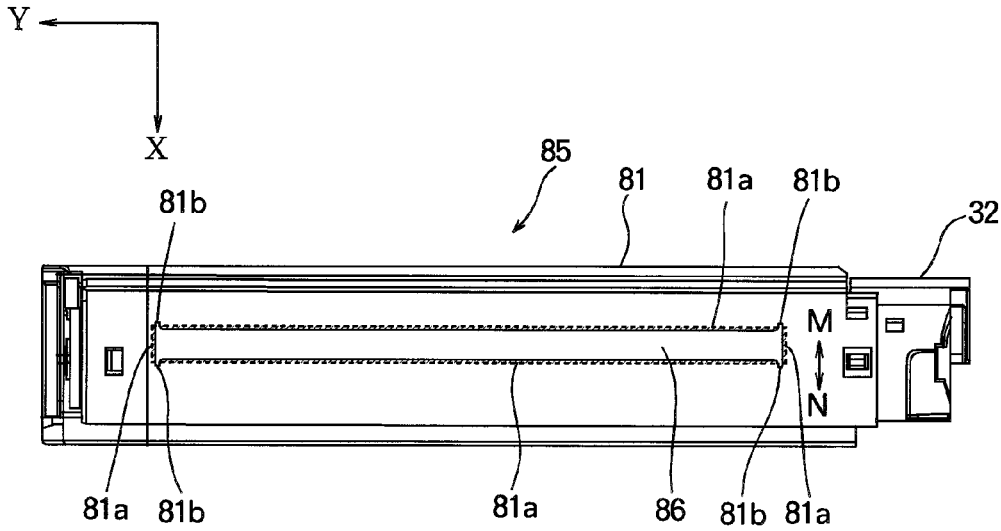
FIG. 17 shows a toner cartridge according to Embodiment 2 of the present invention as seen in the same direction as FIG. 7.
Figure 18:
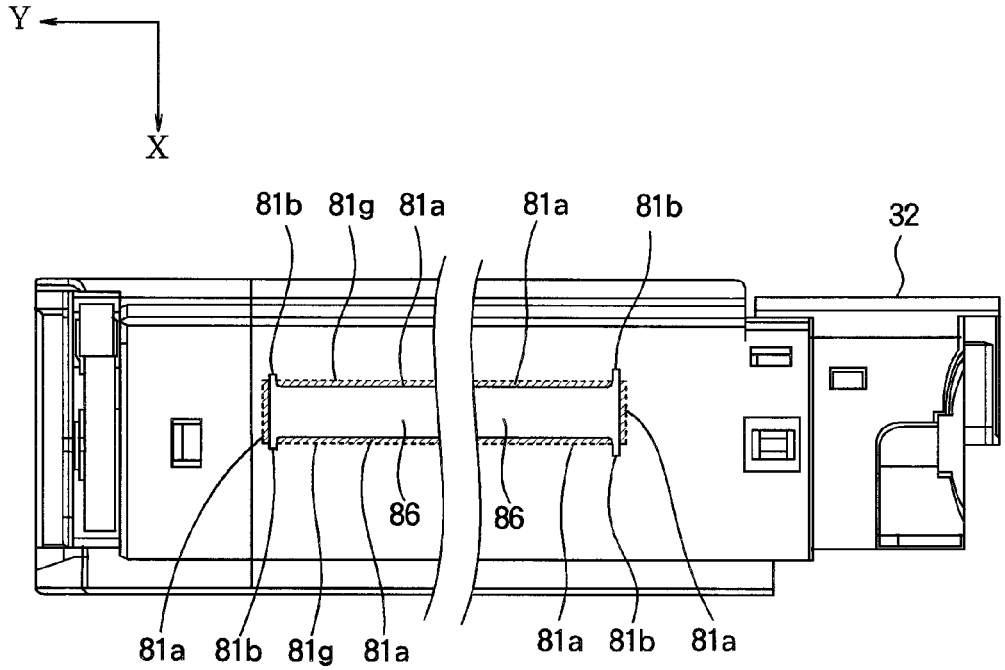
FIG. 18 is an enlarged view showing end portions of the toner cartridge shown in FIG. 17.
Figure 19:
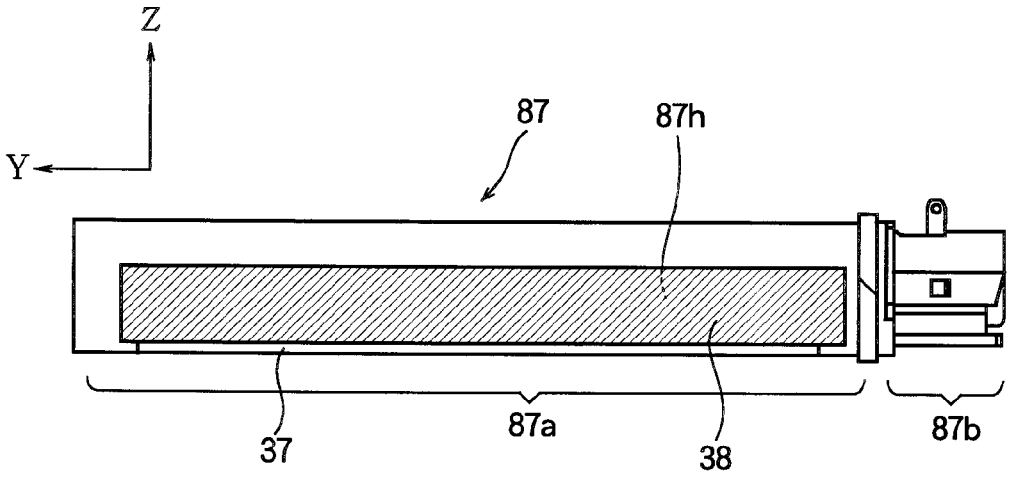
FIG. 19 shows an outer shape of the shutter of Embodiment 2 as seen in the same direction as FIG. 10.
Figure 20:
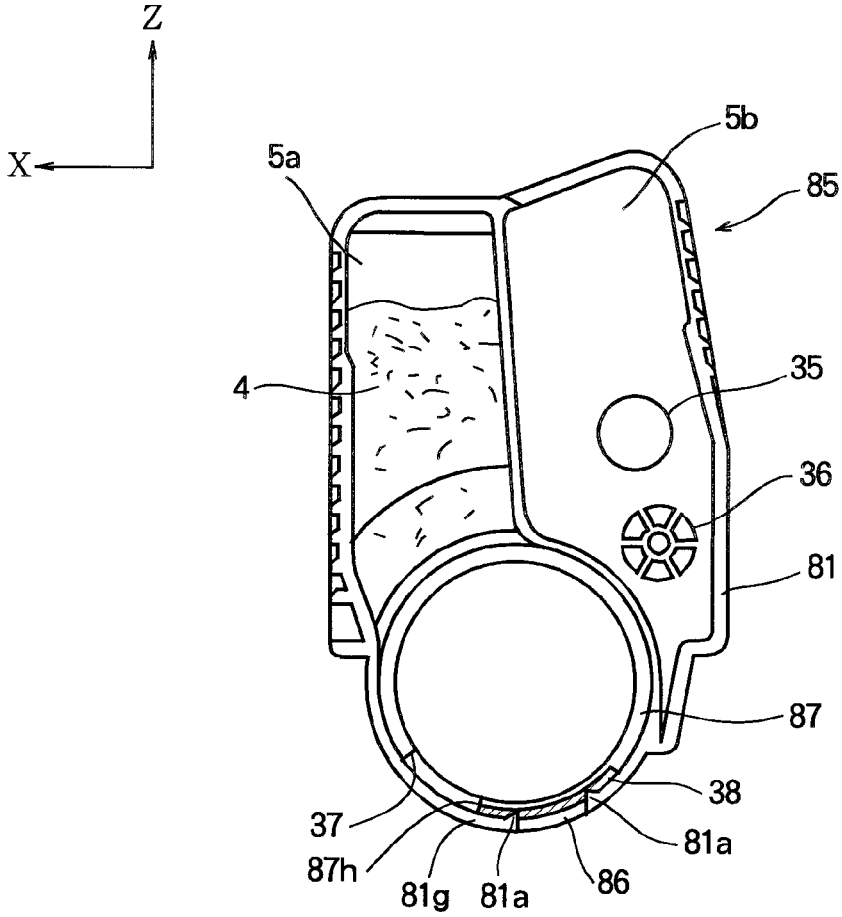
FIG. 20 is a sectional view showing an outer shape of the shutter of Embodiment 2 as seen in the same direction as FIG. 6.

FIG. 17 shows a toner cartridge 85 according to Embodiment 2 of the present invention as seen in the same direction as FIG. 7. FIG. 18 is an enlarged view showing end portions of the toner cartridge 85 shown in FIG. 17. FIG. 19 shows an outer shape of a shutter 87 of the toner cartridge 85 as seen in the same direction as FIG. 10. FIG. 20 is a sectional view showing the toner cartridge 85 as seen in the same direction as FIG. 6.

The toner cartridge 85 of this embodiment is different from the toner cartridge 5 of Embodiment 1 (FIGS. 4 through 8) in shapes of the shutter 87 and the casing 81 (in particular, a part including a toner outlet opening 86). Therefore, components that are the same as those of the image forming apparatus 100 (FIG. 1) of Embodiment 1 are assigned the same reference numerals or omitted in figures, and duplicate description is omitted. The description herein is focused on the difference from Embodiment 1. The image forming apparatus of this embodiment has the same components as those of Embodiment 1 shown in FIG. 1 except the configuration of the toner cartridge 85, and therefore FIG. 1 will be referred as necessary.

As shown in FIGS. 17 and 18, a toner outlet opening 86 is formed on the bottom of the toner cartridge 85 for taking out the toner 4 stored in the toner storing portion 5*a* (FIG. 20) of the toner cartridge 85. The toner outlet opening 86 has an elongated shape in the longitudinal direction of the toner cartridge 85. A protrusion 81*a* is formed on the inside of the toner cartridge 85 so as to surround the toner outlet opening 86 as shown by a broken line in FIG. 18. Four cutout portions 81*b* are formed on (and extends from) four corners of the rectangular toner outlet opening 86. The cutout portions 81*b* extend from the corners of the toner outlet opening 86 in the direction indicated by arrows M and N (FIG. 17) in which the opening 37 is moved by the rotation of the shutter 87.

As shown in FIG. 19, the shutter 87 includes a shutter portion 87*a* and a driving portion 87*b*. The lever 32 (FIG. 17) having been described in Embodiment 1 is mounted to the driving portion 87*b*, and the driving portion 87*b* receives a rotational force applied to the lever 32. The shutter portion 87*a* has an elongated opening 37. The opening 37 has the shape substantially the same as, or slightly larger than the toner outlet opening 86 (FIG. 17) of the toner cartridge 85. A seal-member-fixing portion 87*h* formed on an area directly adjacent to the opening 37. The seal-member-fixing portion 87*h* is larger than the outer dimension of the opening 37. A resilient seal member 38 composed of, for example, a sponge is bonded to the resilient seal member 38. The seal-member-fixing portion 87*h* is thinner than the other portion of the shutter portion 87*a*, so as to facilitate the positioning of the resilient seal member 38. The difference between the shutter 87 of this embodiment and the shutter 33 of Embodiment 1 is that the shutter 87 of this embodiment has no cutout portions 33*d* and 33*e* (FIG. 9).

In this embodiment, a portion (i.e., a substantially rectangular portion) of the casing 81 surrounded by the cutout portions 81*b* and the toner outlet opening 86 at three sides is referred to as a cantilever portion 81*g*, as shown in FIGS. 18, 21A, 21B and 21C. The cantilever portion 81*g* has three free ends facing the cutout portions 81*b* and the toner outlet opening 86 and one remaining end connected to the other portion of the casing 81. Two cantilever portions 81*b* are formed on both sides of the toner outlet opening 86.

The operation for mounting the toner cartridge 85 to the frame upper part 52 of the main body 23*a* of the image forming unit 23 (FIG. 5) and to operate the shutter 87 will be described with reference to FIGS. 21A through 21C.

Figure 21A:
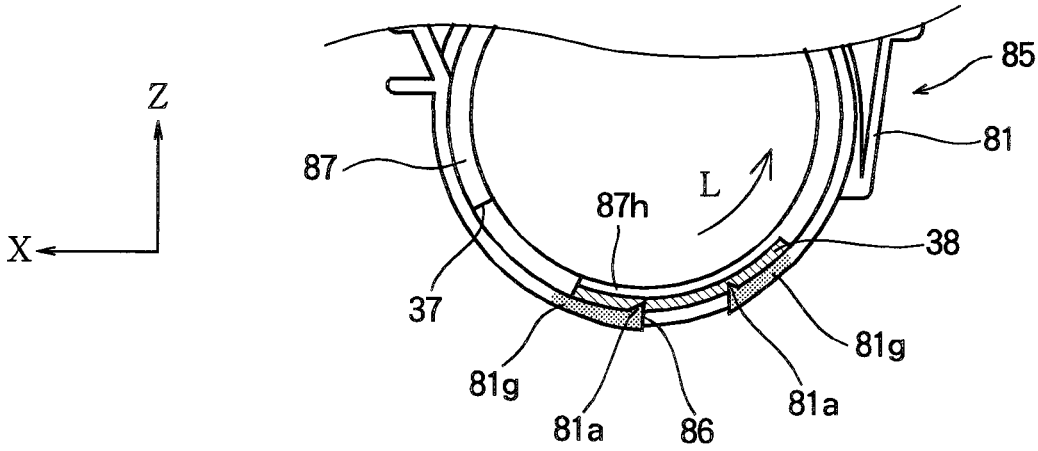
FIGS. 21A through 21C are schematic views for illustrating the operation of the shutter of Embodiment 2.
Figure 21B:
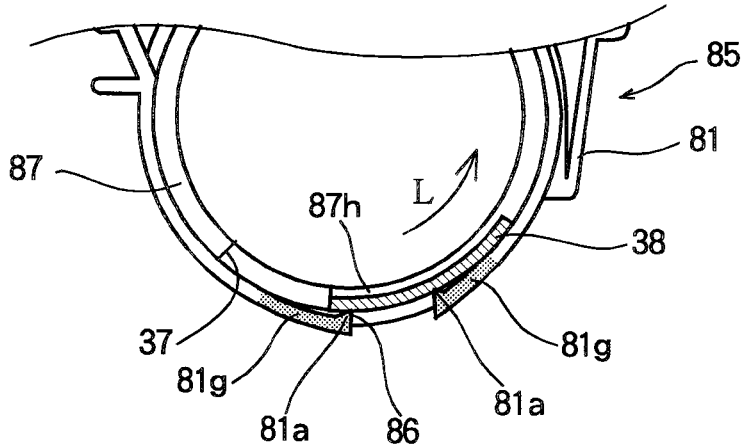
Figure 21C:
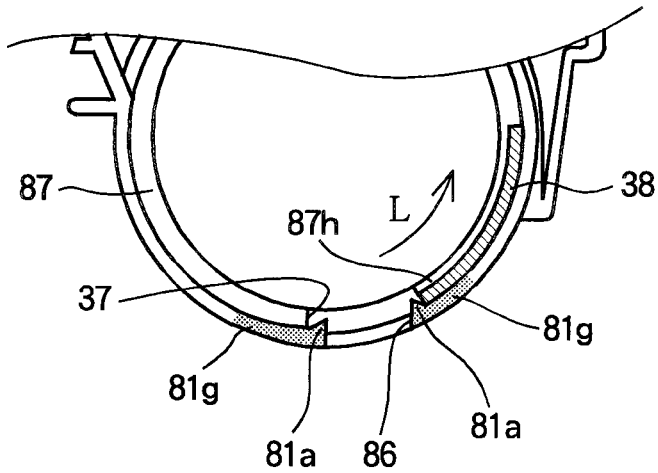

FIGS. 21A through 21C are partial sectional views of the toner cartridge 85 corresponding to the section taken along line XV-XV in FIG. 8. FIG. 21A shows a state where the shutter 87 closes the toner outlet opening 86 of the toner cartridge 85. In the state shown in FIG. 21A, the resilient seal member 38 fixed to the shutter 87 closes the toner outlet opening 86, and the protrusion 81*a* surrounding the toner outlet opening 86 is pushed into the resilient seal member 38 due to the pressing force of the resilient seal member 38. With this, the pressing force applied to the protrusion 81*a* increases, and the leakage path of the toner becomes nested (compared with the case where no protrusion 81*a* is provided). Therefore, the leakage of the toner is prevented by the protrusion 81*a*.

In FIGS. 21A through 21C, a pair of cantilever portions 81*g* are shown by shading. The cantilever portions 81*g* are formed by providing the cutout portions 81*b* (FIG. 18). The tips of the cantilever portions 81*g* face the toner outlet opening 86. The portion of each cantilever portion 81*g* closer to the tip is more likely to be deflected. With such a structure, the cantilever portions 81*g* are deflected by the pressure applied by the shutter 87 via the resilient seal member 38 so that the tips of the cantilever portions 81*a* shift outward. Therefore, even when, for example, there is a variation in dimension of the protrusion 81*a*, thickness of the resilient seal member 38 or the like, a variation (in particular, an increase) in load is restricted by the deflection of the cantilever portions 81*g*.

Further, when pressing force is applied to peripheral portion of the toner outlet opening 86 of the casing 81, the increase in pressing force at both ends is restricted by the deflection of the cantilever portions 81*g*. Therefore, the distribution of the pressing force (applied to the resilient seal member 38) in the longitudinal direction becomes uniform. This prevents the toner leakage at the center portion of the resilient seal member 38 (otherwise caused by the distribution of the pressing force which is weaker at the center portion than at both end portions).

FIG. 21B shows a state where the shutter 87 is rotated in the direction shown by an arrow L and the resilient seal member 38 is slid in the same direction along the toner outlet opening 86 of the toner cartridge 85. In this state, the tips of the cantilever portions 81*g* are pressed by the shutter 87 via the protrusion 81*a*, and therefore the cantilever portion 81*g* is slightly deflected outward while the shutter 87 moves in the direction L. Therefore, the pushing amount of the protrusion 81*a* into the resilient seal member 38 is reduced, which prevents the increase in load (torque) while rotating the shutter 87.

FIG. 21C shows a state where the opening 37 of the shutter 87 and the toner outlet opening 86 are overlapped with each other and where the rotation of the shutter 87 in the direction L is stopped by a not shown limiter. In this state, the tip of the resilient seal member 38 passes the protrusion 81*a*, and each cantilever portion 81*g* returns to its original state where the deflecting amount is small. Thereafter, the agitating bar 39 (FIG. 2) of the toner cartridge 85 is rotated in accordance with the printing operation, and the toner stored in the toner storing portion 5*a* (FIG. 20) is introduced to the toner outlet opening 86, and is supplied to the toner reserving portion 112 (FIG. 2) of the main body 23 of the image forming unit 23. In this regard, when the shutter 87 is in the rotational position shown in FIG. 21C, the projection 65 (FIG. 5) of the frame upper part 52 engages the not shown groove of the lever 32 (FIG. 4), so that the toner cartridge 85 is fixed to the frame upper part 52 of the main body 23*a* of the image forming unit 23.

In contrast, when the toner cartridge 85 is detached from the main body 23*a* of the image forming unit 23, the lever 32 (FIG. 4) is rotated in the direction opposite to the direction L so as to release the fixing of the toner cartridge 85 and to close the toner outlet opening 86. The shutter 87 rotates from the position shown in FIG. 21C to the position shown in FIG. 21A, while the resilient seal member 38 is pressed against the protrusion 81*a* and slides in the direction opposite to the direction L. During this rotation, the cantilever portions 81*g* are deflected outward (so that the tips thereof shift outward) due to the pressing force applied by the shutter 87 via the resilient seal member 38, and therefore the increase in load is prevented.

The deflectable cantilever portions 81*g* (FIGS. 21A through 21C) can be obtained without using the cutout portions 81*b*. To be more specific, it is possible to form portions corresponding to the cutout portions 81*b* to be thinner than the other portion of the shutter portion 87*a*, or to form flexible portions (corresponding to the cutout portions 81*b*) using a resilient member such as a spring or the like so as to allow the deflection of the cantilever portion 81*g*. Furthermore, it is also possible to form the cantilever portion 81*g* using a resilient member such as a spring or the like.

Figure 22A:
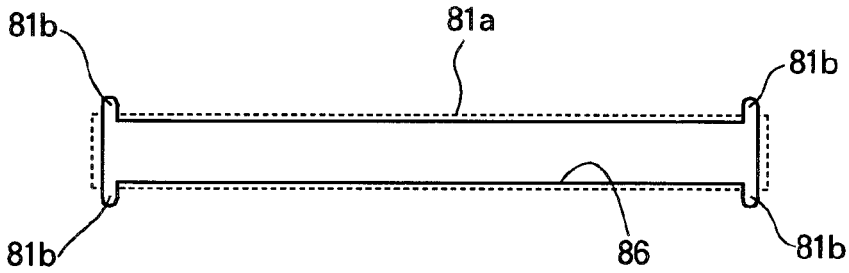
FIGS. 22A through 22D are schematic views for illustrating modifications of a protrusion formed around a toner outlet opening of the casing of the toner cartridge of Embodiment 2.
Figure 22B:
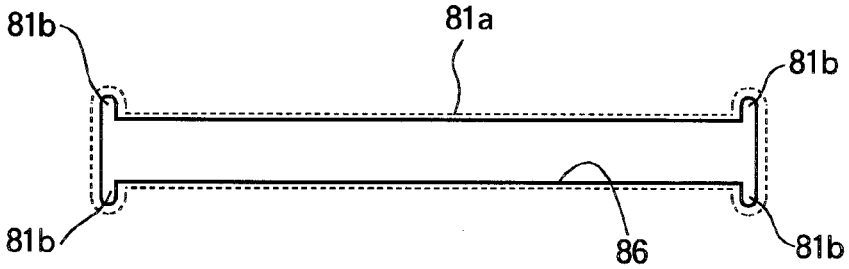
Figure 22C:
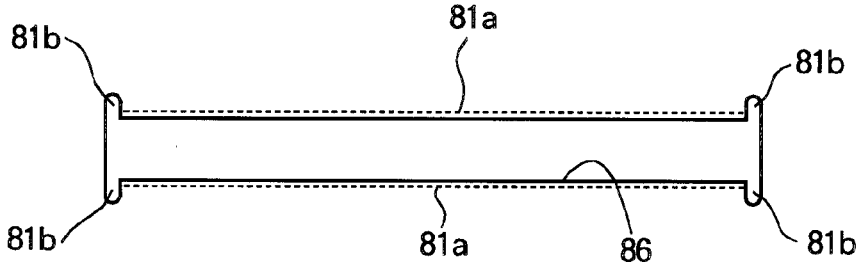
Figure 22D:
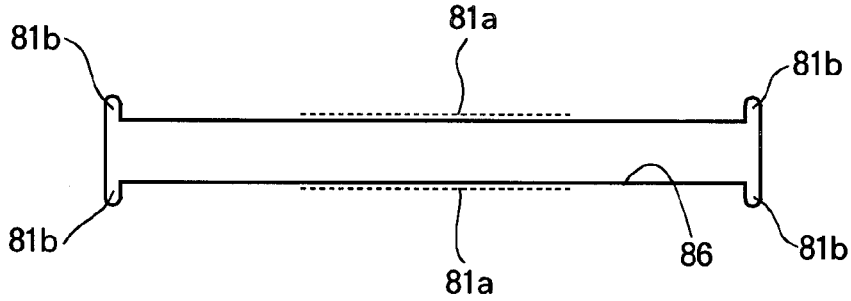

FIG. 22A shows the protrusion 81*a* formed around the toner outlet opening 86 of the toner cartridge 85 of this embodiment. FIGS. 22B and 22C show modifications of the protrusion 81*a*. Although the protrusion 81*a* is formed to surround the toner outlet opening 86 of the toner cartridge 85 in this embodiment as shown in FIG. 22A, the present invention is not limited to such a configuration. For example, as shown in FIG. 22B, it is also possible to form the protrusion 81*a* so as to surround the toner outlet opening 86 and surround the respective cutout portions 81*b*. Further, as shown in FIG. 22C, it is also possible to form protrusions 81*a* on both sides of the toner outlet opening 86 so as to extend throughout the length of the toner outlet opening 86. Further, as shown in FIG. 22D, it is also possible to form protrusions 81*a* on both sides of the toner outlet opening 86 so as to extend along a part of the toner outlet opening 86.

As described above, according to the second embodiment of the present invention, the cantilever portions 81*g* on both sides of the toner outlet opening 86 become deflectable due to the provision of the cutout portions 81*b*. Therefore, the increase in load while operating the shutter 87 can be restricted even if the protrusion 81*a* is formed around the toner outlet opening 86 of the toner cartridge 85 for preventing the leakage of the toner.

Further, the distribution of the pressing force applied to the resilient seal member 38 in the longitudinal direction becomes uniform, and therefore the leakage of the toner can be prevented.

Moreover, the increase in load can be restricted, even when there is a variation in dimension of the protrusion 81*a*, thickness of the resilient seal member 38 or the like.

Additionally, the leakage of the toner can be further restricted by the rib-like protrusion 81*a* pushed into the resilient seal member 38.

Embodiment 3.

Figure 23:
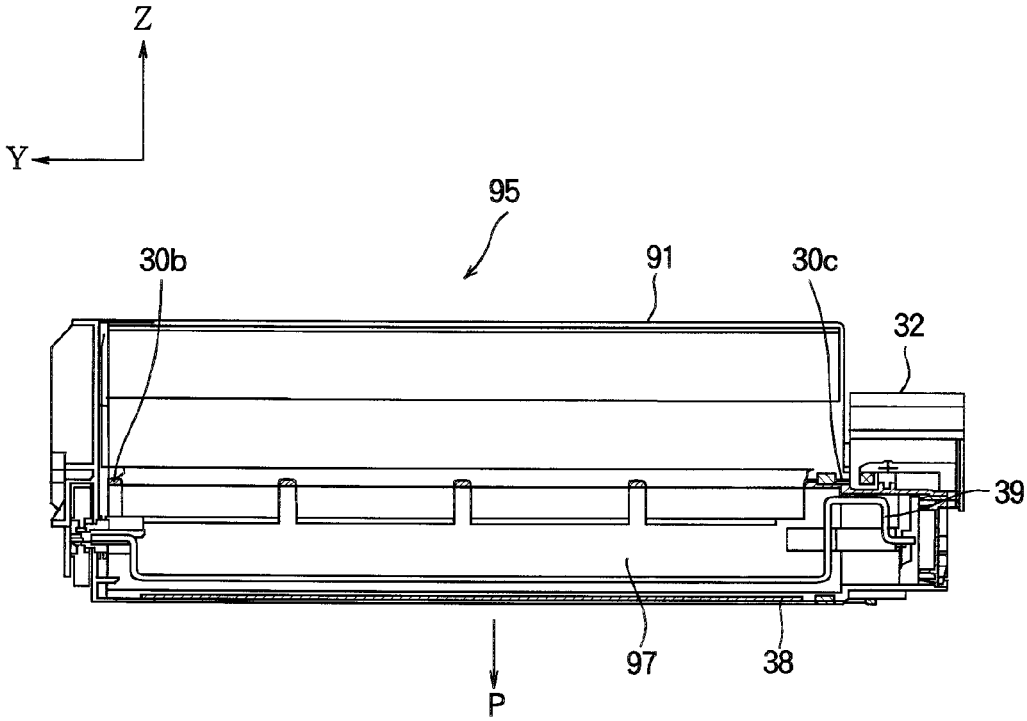
FIG. 23 shows a toner cartridge according to Embodiment 3 of the present invention as seen in the same direction as FIG. 8.
Figure 24:
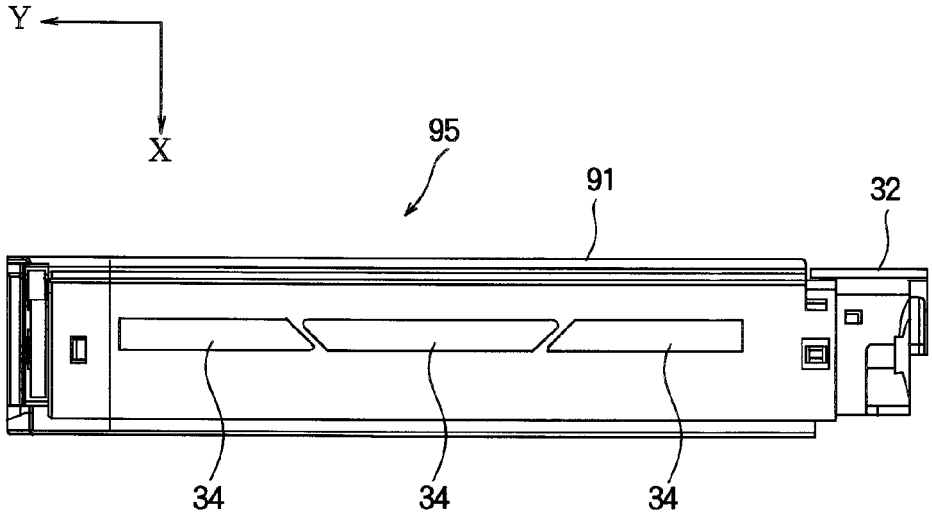
FIG. 24 shows the toner cartridge of Embodiment 3 as seen in the same direction as FIG. 7.
Figure 25:
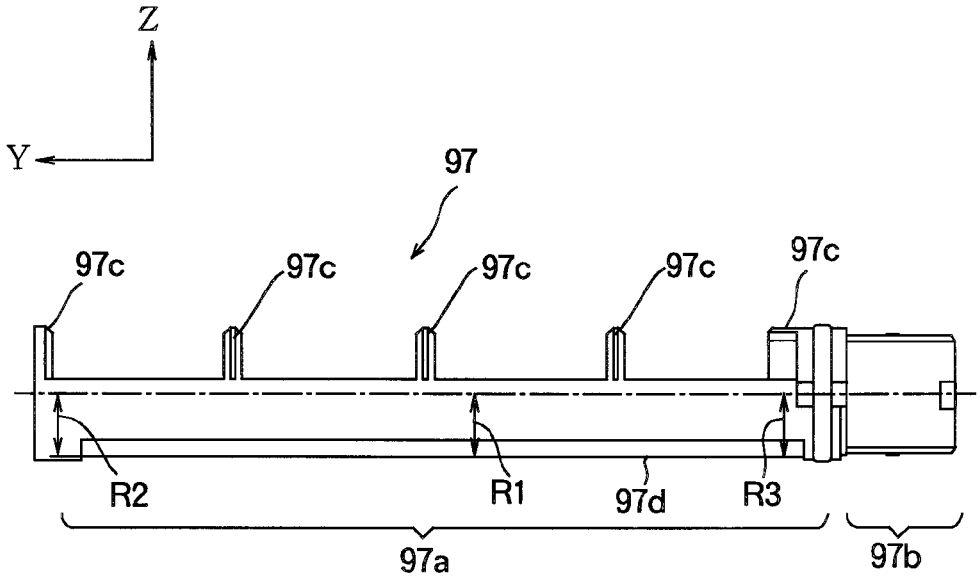
FIG. 25 shows a shutter of the toner cartridge of Embodiment 3 before a resilient seal member is attached to the shutter as seen in the same direction as FIG. 11.
Figure 26:
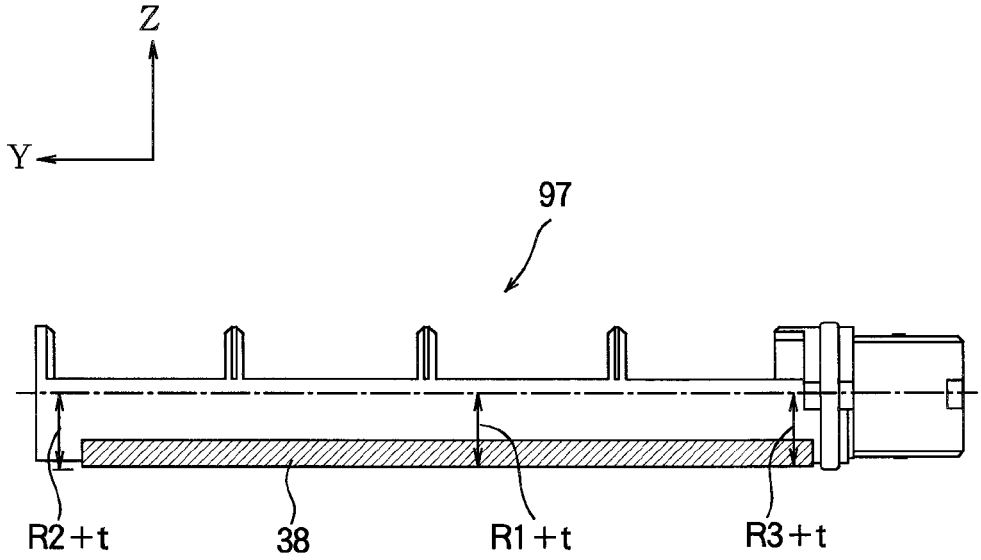
FIG. 26 shows the shutter of the toner cartridge of Embodiment 3 after the resilient seal member is attached to the shutter as seen in the same direction as FIG. 25.
Figure 27:
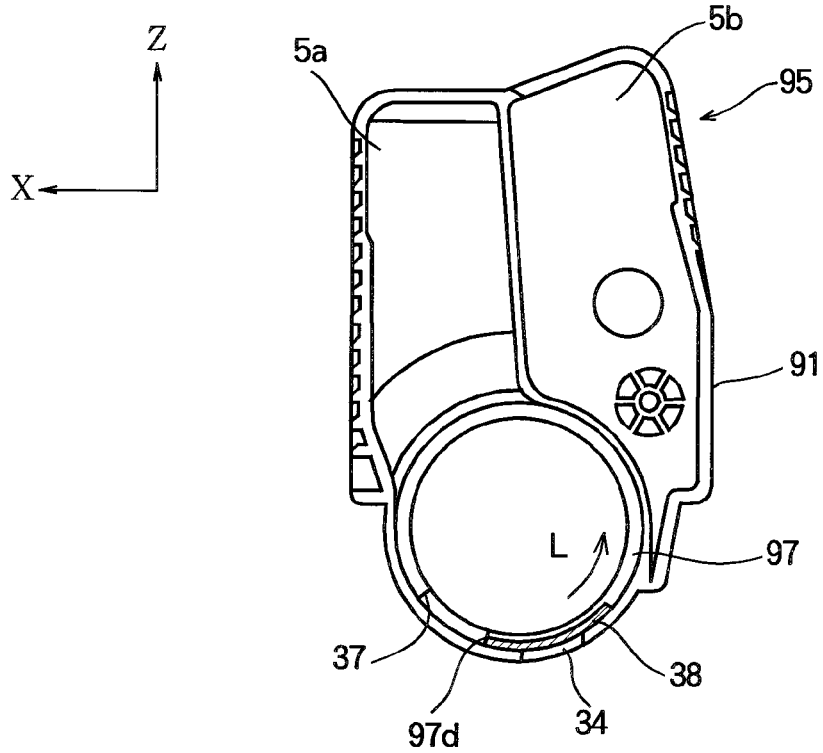
FIG. 27 is a sectional view showing the toner cartridge of Embodiment 3 as seen in the same direction as FIG. 6.
Figure 28:
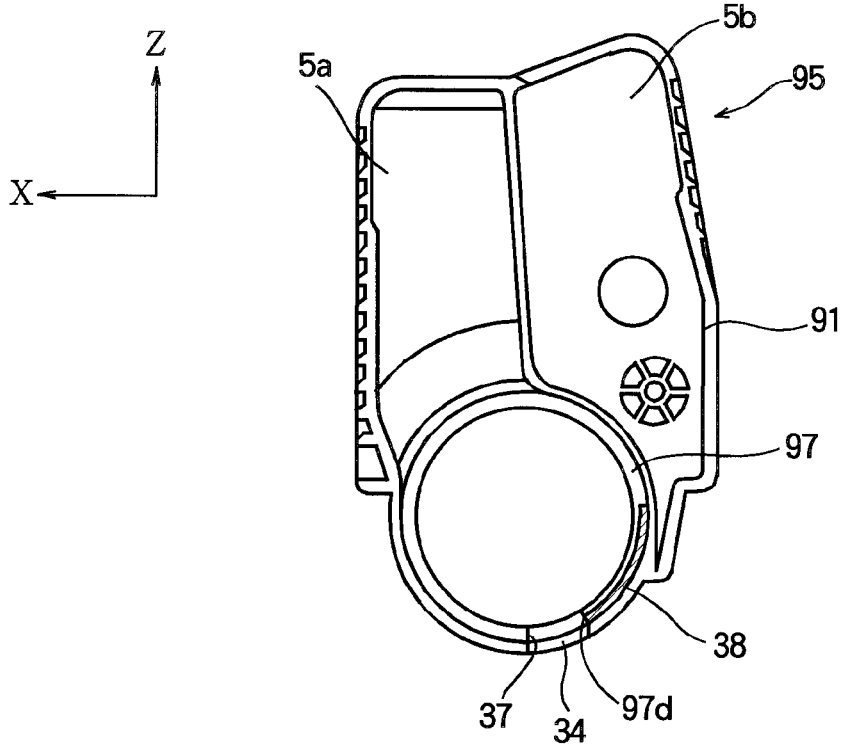
FIG. 28 is a sectional view showing the toner cartridge of Embodiment 3 as seen in the same direction as FIG. 6.

FIG. 23 shows a toner cartridge 95 according to Embodiment 3 of the present invention as seen in the same direction as FIG. 8. FIG. 24 shows the toner cartridge 95 of Embodiment 3 as seen in the same direction as FIG. 7. FIG. 25 shows a shutter 97 of the toner cartridge 95 of Embodiment 3 before a resilient seal member 38 is attached to the shutter 97 as seen in the same direction as FIG. 11. FIG. 26 shows the shutter 97 of the toner cartridge 95 of Embodiment 3 after the resilient seal member 38 is attached to the shutter 97 as seen in the same direction as FIG. 25. FIGS. 27 and 28 are sectional views showing the toner cartridge 95 of Embodiment 3 as seen in the same direction as FIG. 6.

The toner cartridge 95 of the image forming apparatus of this embodiment is different from the toner cartridge 5 of Embodiment 1 (FIGS. 4 through 8) in the shapes of the shutter 97 and the casing 91. Therefore, components that are the same as those of the image forming apparatus 100 (FIG. 1) of Embodiment 1 are assigned the same reference numerals or omitted in figures, and duplicate description is omitted. The description herein is focused on the difference from Embodiment 1. The image forming apparatus of this embodiment has the same components as that of Embodiment 1 (FIG. 1) except the configuration of the toner cartridge 95, and therefore FIG. 1 will be referred as necessary.

The difference between the casing 91 of this embodiment and the casing 30 of Embodiment 1 is that no protrusion 30*a* (FIG. 6) is formed around the toner outlet opening 34 of the casing 91. As shown in FIGS. 23 and 24, the toner cartridge 95 is configured so that a shutter 97 is provided in the casing 91 instead of the shutter 33 of Embodiment 1. Further, the operation to open and close the toner outlet opening 34 of the casing 91 using the lever 32 is the same as the operation to open and close the toner outlet opening 34 of the casing 30 of Embodiment 1, and therefore the duplicate description will be omitted.

As shown in FIG. 25, the shutter 97 includes a shutter portion 97*a* and a driving portion 97*b*. The lever 32 (FIG. 17) having been described in Embodiment 1 is mounted to the driving portion 97*b*, and the driving portion 97*b* receives a rotational force applied to the lever 32. The shutter portion 97*a* has a substantially cylindrical portion half of which is removed except five ribs 97*c* formed at constant intervals. As shown in FIG. 28, the shutter portion 97*a* has an opening 37 having an elongated shape. The opening 37 has the shape substantially the same as, or slightly larger than the toner outlet opening 34 of the toner cartridge 95. A seal-member-fixing portion 97*d* (FIGS. 27 and 28) is formed on an area directly adjacent to the opening 37. The seal-member-fixing portion 97*d* is larger than the outer dimension of the opening 37. A resilient seal member 38 is bonded to the seal-member-fixing portion 97*d*. The resilient seal member 38 is composed of, for example, a sponge. The seal-member-fixing portion 97*d* is thinner than the other portion of the shutter portion 97*a*, to thereby facilitate the positioning of the resilient seal member 38. The shutter portion 97*a* has no cutout portions 33*d* and 33*e* (FIG. 9) having been described in Embodiment 1.

The seal-member-fixing portion 97*d* of the shutter 97 is configured so that the radius (i.e., the distance from a rotation axis 200 of the shutter 97 to the surface of the shutter 97) R1 at the center portion in the longitudinal direction is larger than the radius R2, R3 at the end portions in the longitudinal direction.

The radii R1, R2 and R3 preferably satisfy the following relationships:

$$0.3\ \text{mm} \leqq R1 - R2 \leqq 2\ \text{mm, and}$$

$$0.3\ \text{mm} \leqq R1 - R3 \leqq 2\ \text{mm.}$$

In a state where the resilient seal member 38 (having the thickness "t") is bonded to the seal-member-fixing portion 97*d*, the distance from the rotation axis 200 to the surface of the resilient seal member 38 is larger at the center portion (R1+t) than at the end portions (R2+t, R3+t) in the longitudinal direction.

The above described preferable relationships can be expressed as follows:

$$0.3\ \text{mm} \leqq (R1+t) - (R2+t) \leqq 2\ \text{mm, and}$$

$$0.3\ \text{mm} \leqq (R1+t) - (R3+t) \leqq 2\ \text{mm.}$$

In the toner cartridge 95 (in which the shutter 97 is mounted to the casing 91), when the shutter 97 closes the toner outlet opening 34 as shown in FIG. 27, the resilient seal member 38 of the shutter 97 is pressed against the peripheral portion of the toner outlet opening 34 so as to cover the toner outlet opening 34. When the lever 32 (FIG. 23) mounted to the end portion of the shutter 97 is rotated in the direction indicated by an arrow L, the resilient seal member 38 rotates while being pressed against the inner surface of the casing 91.

Thereafter, when the shutter 97 is in a rotational position where the opening 37 of the shutter 97 and the toner outlet opening 34 of the casing 91 are overlapped with each other as shown in FIG. 28, the rotation of the shutter 97 in the direction L is stopped by means of a limiter (not shown).

When the resilient seal member 38 applies pressing force to the peripheral portion of the toner outlet opening 34, the peripheral portion of the toner outlet opening 34 is more likely to be deflected in the direction P (FIG. 23) at the center portion than at the end portions in the longitudinal direction. Therefore, in this embodiment, the radius R1 at the center portion of the seal-member-fixing portion 97*d* is set to be larger than the radius R2, R3 at the end portions of the seal-member-fixing portion 97*d*. In other words, the distance from the rotation axis 200 to the surface of the resilient seal member 38 is larger at the center portion than at the end portions. With such an arrangement, even when the center portion of the peripheral portion of the toner outlet opening 34 is deflected in the direction P (FIG. 23), the decrease in the compressing amount of the resilient seal member 38 can be restricted, so that the leakage of the toner via the center portion can be restricted.

For comparison, in the case where the distance from the rotation axis 200 to the surface of the seal-member-fixing portion 97*d* is constant throughout the length of the seal-member-fixing portion 97*d*, the pressing force of the resilient seal member 38 is stronger at the both end portions and is weaker at the center portion due to the deflection of the peripheral portion of the toner outlet opening 34 in the direction P (FIG. 23), and therefore the toner leakage is more likely to occur at the center potion.

In this embodiment, the radius R1 at the center portion of the seal-member-fixing portion 97*d* is set to be larger than the radius R2, R3 at the end portions of the seal-member-fixing portion 97*d*, so that the distance from the rotation axis 200 to the surface of the resilient seal member 38 is larger at the center portion than at the end portions. However, the present invention is not limited to such a configuration. For example, it is also possible that the seal-member-fixing portion 97*d* has uniform radius, and the thickness of the resilient seal member 38 is thicker at the center portion than at the end portions in the longitudinal direction.

As described above, according to this embodiment, even when the peripheral portion of the toner outlet opening 34 is deflected by the pressing force of the resilient seal member 38 of the shutter 97 (so that the deflecting amount is the largest at the center thereof), the pressing force applied to the peripheral portion of the toner outlet opening 34 by the resilient seal member 38 can be uniform in the longitudinal direction. Therefore, the leakage of the toner can be prevented.

The present invention is applicable to a toner cartridge, an image forming unit or an image forming apparatus employed in a printer, a facsimile machine, a copier, an apparatus having combined functions, or the like.

While the preferred embodiments of the present invention have been illustrated in detail, it should be apparent that modifications and improvements may be made to the invention without departing from the spirit and scope of the invention as described in the following claims.

What is claimed is:

1. A developer cartridge comprising;

a developer storing portion having an inner cavity in which a developer is stored, and having a first opening through which said developer is ejected, and a shutter member slidably mounted in said inner cavity of said developer storing portion so as to open and close said first opening, said shutter member having a resilient-member-fixing portion to which a resilient member is fixed for preventing leakage of said developer between said shutter member and said developer storing portion, wherein said shutter member has a deflectable part formed on an inner side of said shutter member, said deflectable part defining said resilient-member-fixing portion.

2. The developer cartridge according to claim 1, wherein said shutter member is configured to press said resilient member against an inner surface of said developer storing portion, and said deflectable part is formed on said resilient-member-fixing portion.

3. The developer cartridge according to claim 2, wherein said shutter member supports said resilient-member-fixing portion in a cantilever manner.

4. The developer cartridge according to claim 2, wherein a protrusion is formed around said first opening or formed on a portion along said first opening extending in a direction perpendicular to a direction in which said shutter member is slid.

5. The developer cartridge according to claim 2, wherein said shutter member has a second opening, wherein said shutter member opens said first opening when said shutter member is in a position where said second opening is overlapped with said first opening, and wherein said shutter member closes said first opening when said shutter member is in a position where said resilient member covers said first opening.

6. A developer cartridge comprising:

a developer storing portion that stores a developer and has a first opening through which said developer is ejected; and a shutter member slidably mounted to said developer storing portion, said shutter member having a second opening, a resilient-member-fixing portion adjacent to said second opening, and a resilient member fixed to said resilient-member-fixing portion for preventing leakage of said developer between said shutter member and said developer storing portion, wherein said shutter member is configured to open said first opening when said second opening is overlapped with said first opening, and to close said first opening when said resilient member covers said first opening, wherein said shutter member is configured to press said resilient member against an inner surface of said developer storing portion, and wherein said developer storing portion has a deflectable part formed by a cutout portion or flexible portion extending from said first opening in a direction which said shutter member is slid.

7. The developer cartridge according to claim 1, wherein said shutter member is configured to press said resilient member against an inner surface of said developer storing portion, and said deflectable part is formed on said peripheral portion of said first opening.

8. The developer cartridge according to claim 7, wherein a protrusion is formed around said first opening or formed on a portion along said first opening extending in a direction perpendicular to a direction in which said shutter member is slid.

9. The developer cartridge according to claim 7, wherein said first opening is elongated in a longitudinal direction of said developer storing portion which is perpendicular to a direction in said shutter member is slid, and wherein said deflectable part is formed along a longer side of said first opening.

10. The developer cartridge according to claim 9, wherein cutout portions or flexible portions are provided on both ends of said longer side of said first opening, and extend in said direction in which said shutter member is slid.

11. A developer cartridge comprising:

a developer storing portion that stores a developer and has a first opening through which said developer is ejected;

a resilient member, and a shutter member mounted to said developer storing portion so that said shutter is rotatable about a rotation axis to open and close said first opening, said shutter member having a resilient-member-fixing portion to which said resilient member is fixed and a second opening adjacent to said resilient-member-fixing portion, said shutter member pressing said resilient member against an inner surface of said developer storing portion, said shutter member opening said first opening at a first rotational position where said second opening is overlapped with said first opening and closing said first opening at a second rotational position where said resilient member covers said first opening, wherein the distance from said rotation axis to a surface of said resilient member is smaller at both end portions of said resilient member in the direction of said rotation axis than at a center portion of said resilient member in the direction of said rotation axis.

12. The developer cartridge according to claim 11, wherein the distance from said rotation axis to a surface of said resilient-member-fixing portion is smaller at both end portions of said resilient-member-fixing portion in the direction of said rotation axis than at a center portion of said resilient-member-fixing portion in the direction of said rotation axis.

13. An image forming unit comprising:

said developer cartridge according to claim 1.

14. An image forming apparatus comprising:

said image forming unit according to claim 13.

15. An image forming unit comprising:

said developer cartridge according to claim 11.

16. An image forming apparatus comprising:

said image forming unit according to claim 15.

* * * * *